US008850747B2

(12) United States Patent
Dries

(10) Patent No.: US 8,850,747 B2
(45) Date of Patent: Oct. 7, 2014

(54) DOOR WITH CLOSING PROFILE AND INTEGRATED VENTILATION

(75) Inventor: Rudi Dries, Schilde (BE)

(73) Assignee: Liexco, S.A., Luxembourg (LU)

( * ) Notice: Subject to any disclaimer, the term of this patent is extended or adjusted under 35 U.S.C. 154(b) by 744 days.

(21) Appl. No.: 12/422,338

(22) Filed: Apr. 13, 2009

(65) Prior Publication Data

US 2009/0211161 A1 Aug. 27, 2009

Related U.S. Application Data

(63) Continuation-in-part of application No. PCT/EP2007/060982, filed on Oct. 15, 2007.

(30) Foreign Application Priority Data

Oct. 13, 2006 (BE) ..... 2006/0508
Feb. 26, 2009 (BE) ..... 2009/0119

(51) Int. Cl.
*E06B 7/32* (2006.01)
*E06B 7/22* (2006.01)
*E06B 3/90* (2006.01)

(52) U.S. Cl.
CPC .... *E06B 7/22* (2013.01); *E06B 3/90* (2013.01)
USPC ..... 49/484.1; 49/394; 49/383; 49/475.1; 49/489.1; 49/495.1; 49/493.1

(58) Field of Classification Search
USPC ..... 49/394, 366, 367, 383, 384, 475.1, 49/482.1, 484.1, 489.1, 492.1, 490.1, 49/495.1, 493.1
See application file for complete search history.

(56) References Cited

U.S. PATENT DOCUMENTS 2,934,802 A * 5/1960 Shekter ..... 49/493.1
3,095,225 A * 6/1963 Domsic et al. ..... 292/169.15
4,119,325 A * 10/1978 Oakley et al. ..... 277/642
4,449,267 A * 5/1984 Siemion ..... 15/257.01
4,931,339 A * 6/1990 Malcolm-Brown ..... 428/71
5,107,622 A * 4/1992 Fuchs et al. ..... 49/484.1
5,289,657 A * 3/1994 Kiel ..... 49/478.1
5,311,711 A * 5/1994 Desir, Sr. ..... 52/208

(Continued)

FOREIGN PATENT DOCUMENTS

CH 429103 1/1967
DE 911376 5/1954

(Continued)

*Primary Examiner* — Katherine Mitchell
*Assistant Examiner* — Marcus Menezes
(74) *Attorney, Agent, or Firm* — Jerold I. Schneider; Schneider Rothman IP Law Group

(57) ABSTRACT

The present invention relates to a door assembly comprising two opposite members, at least one of which being a rotatable door, and a closing system which is provided for being mounted to one of the opposite members, wherein the closing system comprises a holder profile, at least one engaging member for engaging a complementary edge part on the opposite member to maintain the door in closed position, the engaging member being at least partly elastically deformable to enable opening of the door in at least one direction, and a blocking member with which the opening of the door can be prevented in one direction or the other, wherein the engaging and blocking members are formed by mutually exchangeable strips which are to different extents compressible and which are releasably mountable to the holder profile of the closing system.

7 Claims, 21 Drawing Sheets

(56) References Cited

U.S. PATENT DOCUMENTS

| | | | | |
|---|---|---|---|---|
| 5,349,782 | A * | 9/1994 | Yulkowski | 49/366 |
| 5,499,475 | A * | 3/1996 | Court et al. | 49/495.1 |
| 5,528,863 | A * | 6/1996 | Scott | 49/480.1 |
| 5,968,615 | A * | 10/1999 | Schlappa | 428/34.1 |
| 6,478,308 | B1 * | 11/2002 | McMillin et al. | 277/630 |

FOREIGN PATENT DOCUMENTS

| | | |
|---|---|---|
| DE | 29721460 | 2/1998 |
| EP | 0230998 | 8/1987 |
| EP | 0497134 | 8/1992 |
| EP | 0645517 | 3/1995 |
| GB | 1237280 | 6/1971 |
| GB | 2123068 | 1/1984 |
| JP | 2003262076 | 9/2003 |
| WO | WO 03078780 | 9/2003 |

* cited by examiner

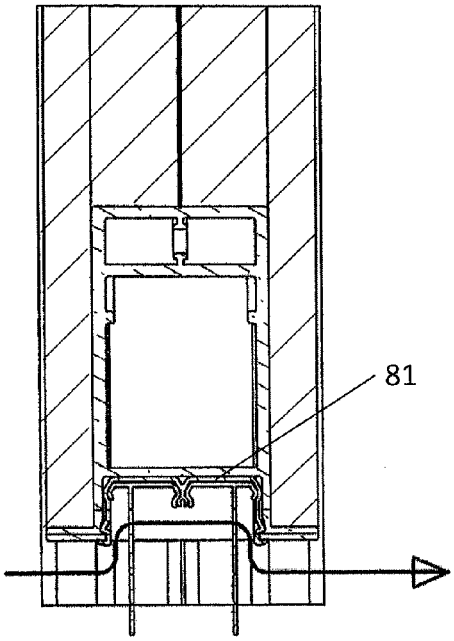
Fig.9A
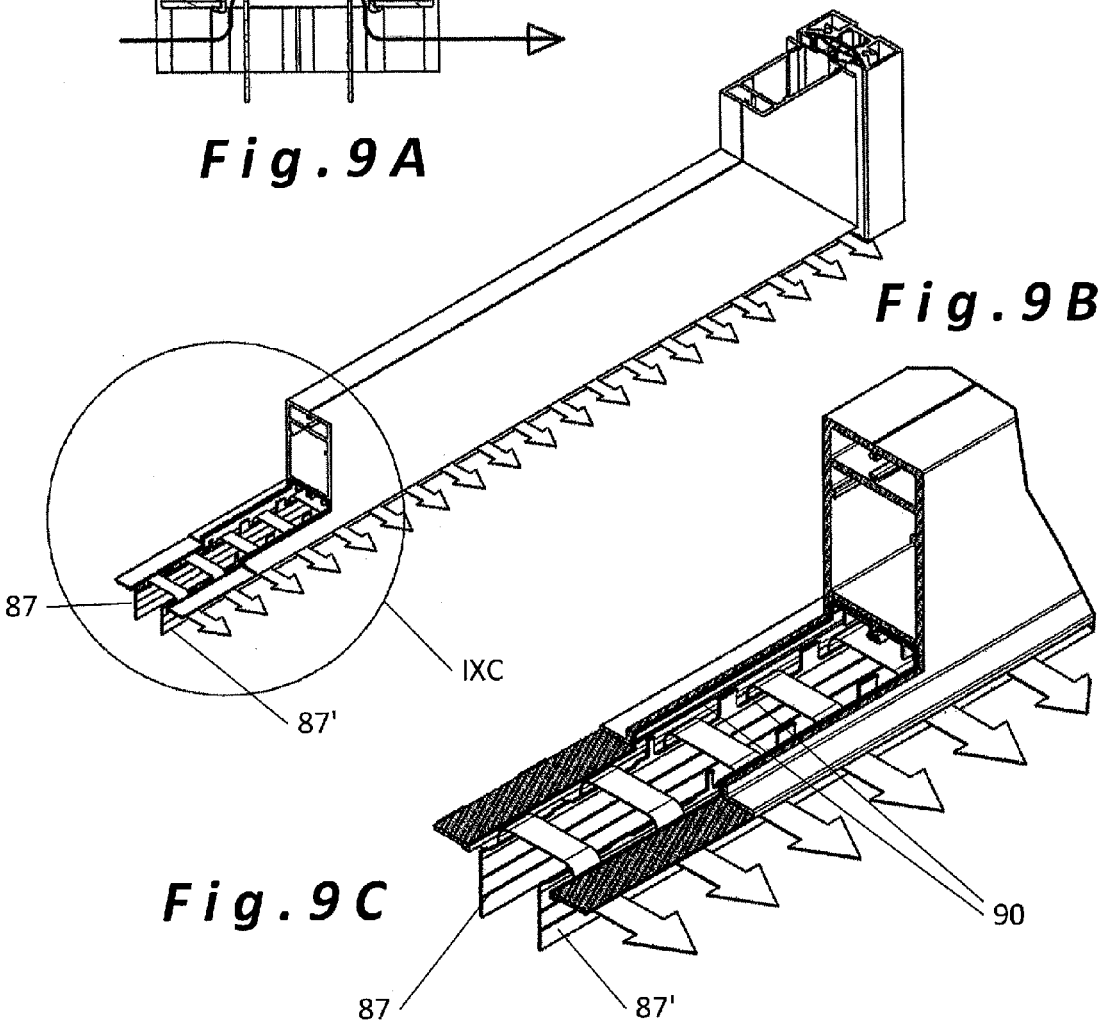
Fig.9B
Fig.9C

DOOR WITH CLOSING PROFILE AND INTEGRATED VENTILATION

CROSS REFERENCE TO RELATED APPLICATIONS

This application is a continuation-in-part of International Application No. PCT/EP2007/060982, filed Oct. 15, 2007, which claims the priority benefit of Belgian Application No. 2006/0508, filed Oct. 13, 2006, and Belgian Application No. 2009/0119, filed Feb. 26, 2009, all of which are incorporated herein by reference in their entirety.

BACKGROUND OF THE INVENTION

1. Technical Field

In a first aspect, the present invention relates to a closing profile provided for mounting on one of two opposite members of a door assembly, at least one of the opposite members being a rotatable door, the closing profile comprising a mounting member by means of which the closing profile is mounted to a reveal part of the one member of the door assembly and a flexible member connected to the mounting member, the flexible member being shaped for engaging a complementary edge part on the other member of the door assembly and for releasably maintaining the door in a closed position, the closing profile comprising a hollow space between the flexible member and the mounting member to enable the flexible member to deform resiliently towards the mounting member upon opening the door.

In a second aspect, the present invention relates to a door assembly comprising a door and a door frame mountable in a wall opening and a number of circumferential profiles fixable to the door and/or the door frame for optically closing gaps between the door and the wall opening, the door optionally comprising an oblong grip profile which divides the door into separate door panel segments extending on opposite sides of the grip profile.

In a third aspect, the present invention relates to a door assembly comprising two opposite members, at least one of which is a rotatable door, and a closing system which is provided for being mounted to one of the opposite members.

2. Background Art

EP-B-0645517 describes a door assembly consisting of a door sheet, jambs and jamb-linings which are to be fitted in a wall opening pertaining thereto. The door is rotatable about a pivot axis on the left or right hand side and may be a two-way door or a one-way door, i.e. a door which opens in one direction only or in both directions. The door and the jamb are provided with complementary bumper and abutment profiles. On at least one side, the bumper profile and abutment profile comprise a length-ways extending, co-operating concave recess and convex projection to retain the door in a closed position. The door is opened by exerting a pressure on the door in a way the convex projection is pulled out of the concave recess.

The profiles which are disclosed in EP-B-0645517 function well. However, practice has shown that since the concave recess snugly fits in the convex projection, the pressure which has to be exerted to open the door is very high. As a result, some users prefer to adjust the position of the door in such a way that a small gap is left between the concave recess and the convex projection. This reduces the pressure needed for opening the door, but enables light to shine through, which may be considered a disadvantage.

In case a closing system is used which releasably maintains a door in a closed position, gaps between the door and the adjacent member of the door assembly may be completely sealed. In general, sealing the gaps between the door and the adjacent member may cause two problems. A first problem is that a vacuum effect takes place in case the door is placed between two adjacent rooms with rather small dimensions. When opening the door in a certain direction, air is pulled out of one of the rooms thereby creating a vacuum. Because of this vacuum effect a higher force has to be exerted on the door to open it, which is not desired. A second problem is that no air can flow from one room to another, which may result in an unhealthy climate inside one of the rooms. In view of new regulations, a minimum amount of ventilation needs to be ensured between two adjacent rooms.

This problem may be solved by mounting a ventilation grid in the door. This ventilation grid can be seen from outside and has a negative effect on the aesthetic appearance of the door.

SUMMARY OF THE INVENTION

It is a first aim of the invention to provide a door assembly with a closing profile provided for releasably maintaining a door in a closed position, with which gaps between the door and the adjacent member of the door assembly can be avoided and simultaneously the pressure needed to open the door can be reduced.

It is a second aim of the invention to provide a door assembly comprising a door mounted in a wall opening, in which gaps between the door and the wall opening are optically closed and which comprises an integrated ventilation system which cannot be seen from outside.

It is a third aim of the invention to provide a door assembly with a closing system which can be more easily adapted to different circumstances.

At least one of these aims is achieved according to the invention with a door assembly as defined in each of the independent claims.

In embodiments according to the invention, the first, second and third aspects described below may be combined. However, the first, second and third aspects may also be applied independently from each other.

The closing profile according to a first aspect of the present invention comprises a flexible member which is longitudinally divided into two wings, each being provided for engaging the complementary edge part and maintaining the closed position in one direction of opening the door, the wings being bendable independently from each other towards the mounting member.

The closing profile is provided for releasably maintaining a door in a closed position. The closing profile comprises at least two members which are connected to each other, more particularly a mounting member and a flexible member. A hollow space is left between the mounting member and the flexible member. The mounting member is mounted to a reveal part of a first member of a door assembly, for instance a vertical or horizontal door frame or a vertical or horizontal edge of a door. The flexible member is divided into two wings. Each of the wings cooperates with a complementary edge part of a second member of a door assembly adjacent the first member of the door assembly, for instance an adjacent vertical or horizontal edge of a door or a vertical or horizontal edge of a door frame. Because both wings contact a complementary edge part of an adjacent member of a door assembly, the wings close possible gaps between the door and the door frame, between the door and the surrounding wall or between subsequent doors. As a result, because the door may close off one room from another, the door may be used in a number of different situations. The door may for instance by used as a fire door, acoustic isolating door, thermal isolating door, etc.

An analysis of the problem of the prior art has shown that the high pressure needed for opening the door is caused by the fact that the whole flexible member, i.e. the parts of the bumper profile on both sides of the concave recess, have to be deformed to push the convex protrusion out of the recess. Notwithstanding the fact that the closing profile of the invention still substantially perfectly closes off the gap, it is no longer necessary to exert very high pressures on the door in order to open it. This is due to the construction with two wings of the flexible member which are independently bendable from each other towards the mounting member. When the door is to be opened in a certain direction, only one of the two wings is bent towards the mounting member, while the other is not deformed. As a result, not the whole flexible member of the closing profile is deformed as was the case in the prior art and the pressure to be exerted on the door in order to open it, may be reduced as compared to the prior art.

Another advantage of the fact that only part of the flexible member is deformed and less pressure has to be exerted on the door to open or close it, is that the flexible member and the complementary edge part on the opposite member of the door assembly experience less friction, so that wear on these parts can be reduced.

Preferably, the closing profile of the first aspect of the invention further comprises a flexible lip for further closing off the door and avoiding gaps between adjacent door assembly members. The flexible lip is provided on the mounting member and extends in a gap between the two wings of the flexible member of the closing profile. In use, the flexible lip contacts the complementary edge part of an adjacent member of a door assembly. In this way, the closing profile provides for a tree-point closing off system: the two wings and the flexible lip each contact the complementary edge part of an adjacent member of a door assembly and are independently bendable from each other.

The flexible lip preferably comprises a plurality of tearable strips connected to each other by weak portions. This makes it possible to adjust the length of the flexible lip in order to assure contact between the closing profile and the complementary edge part of an adjacent member of a door assembly. It is for instance possible that the shape of the complementary edge part of the adjacent member is a bit irregular along its length or that the wall opening in which the door is mounted is not perfectly straight. This could result in possible gaps between the closing profile and the complementary edge part of the adjacent member. In order to overcome this, the length of the flexible lip may be adjusted by tearing off one or more strips or parts thereof.

Another advantage of the closing profile according to the first aspect of the present invention is that a 2-way door, i.e. a door which can be opened in two directions, can be more easily adjusted to a 1-way door, i.e. a door which can only be opened in one direction. With the closing profile of the invention, it is not necessary to replace the closing profile or an opposite profile by another profile. This is achieved because of the hollow space which is provided between the two wings and the mounting member. This hollow space is provided for receiving a blocking part for blocking deformation of the wing towards the mounting member. Preferably the same hollow space with the same dimensions is provided between each of the two wings and the mounting member, so that the same blocking part can be inserted in each of these spaces. In this way the same blocking part can be used to block the opening of the door in the one direction as well as in the other direction.

The closing profile does not only offer an easier way to switch from a 2-way door to a 1-way door and vice versa. This construction also has the advantage, that the 1-way and 2-way profiles are visually almost identical, since the blocking part is hidden in the hollow space behind the respective wing.

It is not necessary that the closing profile has a convex/concave form that perfectly matches with a concave/convex form of a corresponding edge provided by a door, floor or corresponding profile. The closing profile according to the first aspect of the invention preferably cooperates with a complementary edge part of an edge profile which comprises a trapezoidal protrusion on the edge profile. The trapezoidal form has the advantage that less pressure is to be exerted in order to open the door as compared to for example a concave or convex protrusion. Furthermore, the edge part of a glass door also has a trapezoidal form. In this way the same closing profile may be used to cooperate directly with an edge part of a glass door or with an edge profile with a trapezoidal protrusion provided on an adjacent door or door frame.

The door assembly according to the second aspect of the present invention comprises a door and a door frame which are mounted in a wall opening. The door assembly further comprises a number of circumferential profiles. Each of the circumferential profiles preferably comprises a mounting member by means of which the circumferential profile is mounted to a reveal part of the door or the door frame. Each of the circumferential profiles preferably further comprises a sealing member provided for optically closing the gaps between the door and the wall opening, i.e. between the door and the door frame and/or between the door and the floor.

The door may comprise one door panel or two or more door panels, for instance a front and a back door panel or an upper and lower door panel. Optionally, the door comprises an oblong grip profile which extends over an entire dimension of the door and divides the door into separate door panel segments extending on opposite sides of the grip profile, e.g. an upper and a lower door panel segment or a left hand and a right hand door panel segment or in both an upper left, upper right, lower left and lower right panel segment. Examples of grip profiles of this type are described in detail in EP-A-1696090, which is incorporated by reference herein in its entirety. As used herein, with grip profile is meant a profile which can in itself function as a grip and/or a profile which is provided for mounting a grip.

The door assembly according to a second aspect of the present invention is characterized in that at least a first of the circumferential profiles and/or the oblong profile comprises an integrated ventilation system and is constructed such that the integrated ventilation system is hidden in the profile and penetration of light therethrough is avoided.

In order to allow air flow from one room to another, the door assembly comprises an integrated ventilation system which is invisible from outside. The integrated ventilation system is hidden in at least one of the profiles of the door assembly and is provided in a way that light passing through the ventilation system is avoided. The integrated ventilation system may be provided in a circumferential profile, or in case the door assembly comprises a grip profile, in the grip profile, or in both a circumferential profile and a grip profile.

The integrated ventilation system may for instance be provided in a first example of a circumferential profile as has already been described above, namely the edge profile comprising the complementary edge part which the closing profile according to the first aspect of the invention is provided to engage. The sealing member of this edge profile comprises a trapezoidal protrusion which is provided for closing off gaps between the edge profile and the closing profile, i.e. between the door and the wall opening. This edge profile comprises a mounting member by means of which the edge profile is mounted on a vertical or horizontal edge of the door or door frame, preferably in a snap-fitting way. The trapezoidal protrusion of the sealing member cooperates with a complementary edge part of an adjacent profile, mounted in a vertical or horizontal edge of an adjacent door or door frame. The trapezoidal protrusion cooperates for instance with the flexible member of the closing profile according to the first aspect of the invention. Because the flexible member of the closing profile contacts the trapezoidal protrusion of the edge profile, gaps between the two profiles are avoided and light cannot penetrate therethrough. However, ventilation is made possible by means of perforations provided in the mounting member of the edge profile. The perforations are made on both sides of the trapezoidal protrusion in a way that air can flow from one room, in particular through the perforations on one side of the trapezoidal protrusion via a space behind the sealing member through the perforations on the other side of the trapezoidal protrusion, into the other room. The amount of ventilation may be varied by varying the size and number of perforations or by providing the perforations along only part of the edge profile. Because the ventilation is integrated in the edge profile, the ventilation system is invisible from outside and the aesthetic appearance of the door remains unchanged.

The integrated ventilation system may for instance be provided in a second example of a circumferential profile, namely a circumferential profile which comprises a flexible lip with an adjustable length, which is provided for closing off gaps between the door and the wall opening, for instance for closing off gaps between a lower edge part of the door and the floor or between the door and the door frame. This circumferential profile comprises a mounting member by means of which the circumferential profile is mounted on a vertical or horizontal edge of the door or door frame, preferably in a snap-fitting way. The circumferential profile further comprises at least one flexible lip which is provided for closing off gaps between the door or door frame and an adjacent door, door frame, floor or sealing. The flexible lip can be used for closing off gaps of a different height or width because it has an adjustable length. Because the flexible lip contacts an edge part of an adjacent door or door frame or the floor or sealing light cannot penetrate therethrough. However, ventilation is made possible by means of perforations provided in the flexible lip. The perforations are made in the vicinity of the mounting member, so that they are hidden and invisible from the outside. Air can flow from one room to another through the perforations. The amount of ventilation may again be varied by varying the size and number of perforations or by providing the perforations along only part of the circumferential profile.

In case the door assembly comprises a grip profile, the integrated ventilation system may also be provided in the grip profile. In order to provide good grippability for users, the oblong grip profile preferably has a front, respectively back opening which widens from the front, respectively back surface towards the middle of the door panel segments. A first preferred embodiment of such an integrated ventilation system is provided by what is called herein the "mailbox ventilation system" and a second preferred embodiment of such an integrated system is provided by what is called herein the "insert-grab ventilation system".

The mailbox ventilation system is provided as follows. The oblong grip profile comprises inwards pivotable plates at the front and back openings of the oblong profile, which visually close off these front and back openings. The inwards pivotability of the plates is provided for enabling a user to push one of the plates inwards to grip the oblong grip profile at the front or back opening and open or close the door. The plates are mounted in such way that a permanent minimal ventilation gap is present between the oblong profile and the inwards pivotable plates. In this way air can flow from one room to another. Because the plates extend substantially parallel to the door panel segments, the minimal ventilation gap is almost invisible from outside and there is no negative effect on the aesthetic view of the door.

The insert-grab ventilation system is provided as follows. The oblong grip profile preferably comprises an upper and lower profile, dividing the door in an upper and lower panel segment. The front opening extends between the left hand side of the upper and lower profile and the back opening extends between the right hand side of the upper and lower profile. In this embodiment, the oblong grip profile comprises a ventilation grid provided substantially in the middle of the door panel segments. The perforations in the ventilation grid are substantially invisible from outside because they are provided in an interior space of the grip profile between the narrow front and back openings. Because the front and the back opening of the oblong grip profile widens from the front, respectively back surface towards the middle of the door panel, a substantially invisible space is indeed created in the middle, especially in the vicinity of the upper and lower profile of the oblong grid profile.

In the door assembly according to the third aspect of the invention the engaging and blocking members, respectively for engaging the complementary edge part on the opposite member to maintain the door in closed position and for preventing the opening of the door in one direction or the other, are provided by mutually exchangeable strips which are to different extents compressible and which are releasably mountable to a holder profile of the closing system. This means that there is a predetermined difference in compressibility of the mutually exchangeable strips, so that the closing system is adaptable by exchanging on or more strips. In this way it suffices to for example remove a highly compressible strip, which is intended only for engagement, and replace it with another, less compressible strip, which is intended for blocking, to convert a door which can be opened in two directions into a door which can only be opened in one direction. In order to change the direction in which the door opens at a later point in time, it is sufficient to simply switch the two strips present.

The closing system according to the third aspect of the invention furthermore has the advantage that one or more strips can be easily and quickly replaced in case of wear. Further it is possible to provide a variety of strips with different extents of compressibility for different circumstances, for example to adjust the closing force.

In preferred embodiments, the holder profile comprises a middle part with holding parts on opposite sides thereof for releasably holding a complementary holding part of each time one of the exchangeable strips, such that in closed position the complementary edge part is located in between the exchangeable strips. Preferably, the holding parts of the holder profile and the complementary holding parts of the strips together form a snap connection, so that the exchange becomes very simple.

In preferred embodiments, the holding parts are formed by recesses in the holder profile and the complementary holding parts are formed by teeth on the exchangeable strips, which snap into the recesses.

In preferred embodiments, the exchangeable strips comprise each a protrusion, which protrudes with respect to the holder profile.

Preferably, at least one of the strips comprises a protruding part in a highly compressible material, such as for example polyurethane foam in a polyethylene coating, so that this strip forms an engaging strip for maintaining the door in closed position and enabling opening of the door by compression of the protruding part.

Preferably, at least one of the strips comprises a protruding part in a lightly compressible material, so that this strip forms a blocking strip for preventing opening of the door in one direction. By constructing the blocking strip in a lightly compressible material, such as for example rubber, one obtains the advantage that this strip is to a certain extent deformable and a soft engagement edge is achieved which dampens the closing movement of the door.

In preferred embodiments, the mutually exchangeable strips comprise at least one engaging strip and a blocking strip, the engaging strip protruding less with respect to the holder profile than the blocking strip and the engaging strip being more compressible than the blocking strip.

BRIEF DESCRIPTION OF THE DRAWINGS

The invention will be further elucidated by means of the following description and the appended figures.

FIGS. 8 and 9 show an integrated ventilation system provided in the flexible lip of a circumferential profile of a door assembly according to the present invention.

DETAILED DESCRIPTION

The doors shown in the figures are rotatable about a vertical axis and fit in wall openings. The wall openings may be provided with door frames. The doors may be rotatable in one or in both directions over for example 90°. The doors each time comprise two vertical edges and two horizontal edges. The rotation axis of each door may be provided near one of its vertical edges or somewhere between its first and second vertical edges, i.e. a centrally rotatable door. In some cases a double door is fitted in the wall opening, i.e. two adjacent doors with adjacent vertical edges, as is shown in FIGS. 4 and 5.

Figure 1A:
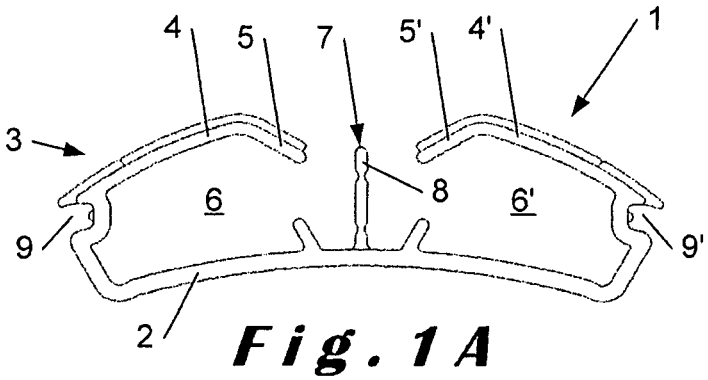
FIG. 1 shows a general overview of preferred embodiments of circumferential profiles of door assemblies according to the present invention.

The closing profile shown in FIG. 1A is applied in each of the cases shown in FIGS. 2-7. The specific area where the closing profile is used is indicated by a circle.

The closing profile 1 of FIG. 1A comprises a mounting member 2 which is provided for mounting the closing profile 1 to a first door assembly member 92, for example a door frame or a door edge. The closing profile 1 preferably extends along the whole length of the reveal part to which it is mounted. The closing profile 1 further comprises a flexible member 3 connected to the mounting member 2. The flexible member 3 is shaped for engaging a complementary edge part 13, 94 of a second door assembly member 93. The flexible member 3 of the closing profile 1 is divided into two wings 4, 4' which are bendable independently from each other towards the mounting member 2. Each of the two wings 4, 4' is positioned for contacting a complementary edge part 13, 94 of the second door assembly member 93, to maintain the door in its closed position. At the same time, possible gaps between the first and the second door assembly members can be optically closed to avoid that light passes through it.

With the closing profile 1 of FIG. 1A, it is not necessary to exert very high pressures on the door in order to open it. This is due to the construction with the two separate wings 4, 4' of the flexible member 3. Bending of the two wings 4, 4' is possible because the two wings 4, 4' are made in a flexible material and a hollow space 6, 6' is provided between the flexible member 3 and the mounting member 2. When the door is opened or closed in a first direction only one of the two wings 4, 4' is bent towards the mounting member 2. For instance in case the door is opened or closed in a direction indicated by the arrow A as is shown on FIG. 2, only the upper wing 4' is bent towards the mounting member in a direction indicated by the arrow A as is shown on FIG. 2. As a result, because only half of the flexible member 3 is deformed when opening or closing a door, the pressure to be exerted on the door for opening or closing the door can be strongly reduced with respect to a unitary flexible member as in the prior art.

Figure 7A:
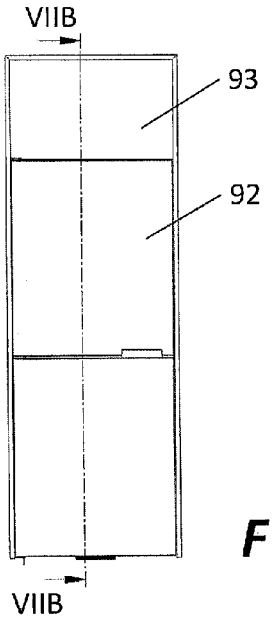
FIG. 7 shows a cross section of a closing profile according to the present invention provided in an upper horizontal edge of a door which cooperates with a fixed panel provided above the door.
Figure 7C:
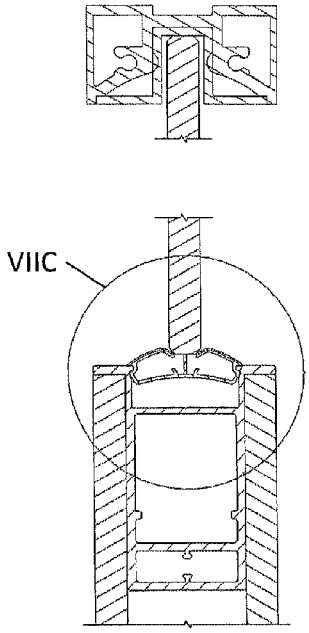
Figure 7C:
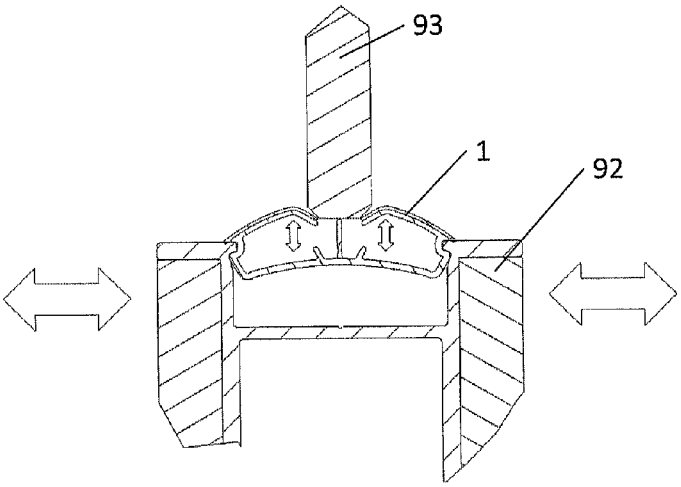

The two wings 4, 4' of the closing profile 1 of FIG. 1A are bendable about an axis of rotation provided on opposite side parts of the closing profile. This contributes to the strength and the stability of the closing profile 1. However, the axes of rotation may be provided on any other position ought suitable by the person skilled in the art. The two wings 4, 4' of the flexible member 3 of the closing profile 1 of FIG. 1A comprise sloping end parts 5, 5' for contacting the complementary edge part 13, 94 of the second door assembly member 93. In this way, the closing profile 1 is in particular suited for cooperation with a complementary edge part 13, 94 which comprises a trapezoidal protrusion, for instance an edge profile 11 with a trapezoidal protrusion 13 as shown in FIG. 1B or an edge 94 of a glass door as shown in FIG. 7C.

The closing profile 1 of FIG. 1A comprises a flexible lip 7 connected to the mounting member 2. The flexible lip 7 is provided in a gap between the two wings 4, 4' and the length of the flexible lip 7 is such that it also contacts the complementary edge part 13, 94 of the second door assembly member 93. In this way, the two wings 4, 4' as well as the flexible lip 7 contact the complementary edge part 13, 94 of the second door assembly member 93, resulting in an even better optical closing of gaps between the first 92 and the second 93 door assembly member. If desired, more than one flexible lip 7 may be provided in the gap between the two wings 4,4'. In this way the optical closing of gaps may be further optimized. The flexible lip 7 is made in a flexible material and is preferably non-transparent for light.

As shown in FIG. 1A the flexible lip 7 comprises a number of tearable strips 8 connected to each other by weak portions. This makes it possible to use this same closing profile 1 in a number of different situations. A precise contact between the flexible lip 7 and the complementary edge part 13, 94 can be assured, because the length of the flexible lip 7 may be adjusted in a very easy way by simply tearing off one or more of the strips.

Another advantage of the closing profile 1 of FIG. 1A is that a 2-way door, as is shown in FIG. 2, can be easily adjusted to a 1-way door as is shown in FIG. 3. This is done by placing a blocking part 95 in the hollow space 6, 6' between one of the wings 4, 4' and the mounting member 2 as is shown in FIG. 3. The blocking part 95 as shown in FIG. 3 has a hollow shape which fits in the hollow space 6' between one of the wings 4' and the mounting member 2. The blocking part 95 can however also be a massive piece of material. The blocking part can for example be made in a material which is substantially non-deformable, but this is not essential. In fact, the blocking part can also be formed by a slightly compressible element which is shaped for substantially completely filling out the space 6, 6' between the wing 4, 4' and the mounting member 2, as long as the element as a whole provides sufficient resistance against depression of the wing 4, 4' towards the mounting member 2 to provide the blocking function.

In the closing profile 1 of FIG. 1A, the first 6 and second 6' hollow spaces between respectively the first wing 4 and the mounting member 2 and the second wing 4' and the mounting member 2 are substantially identical. In this way the same blocking part 95 can be used for blocking the rotation of the door in either direction, i.e. either one of the directions A and B indicated on FIG. 2.

In FIGS. 2, 3 and 6 the first door assembly member 92, to which the closing profile 1 of FIG. 1A is mounted, is a door frame. In these figures it is shown that the closing profile 1 is not directly mounted on a reveal part of the door frame, but is mounted with the aid of a corresponding profile 21 on a reveal part of the door frame. In fact, in a first step the corresponding profile 21 is mounted with its mounting member 22 on the reveal part of the door frame and in a second step the closing profile 1 is mounted on the corresponding profile 21. This latter mounting is made possible because the mounting member 2 of the closing profile 1 comprises recesses 9, 9' on opposite ends which are snap-fittable onto complementary protrusions 29, 29' of the corresponding profile 21, as is shown in FIGS. 2, 3 and 6. However, any other method for mounting the closing profile 1 on the corresponding profile 21 ought suitable by the person skilled in the art may be used. This mounting may for instance be done with cooperating positioning means on the closing profile 1 and corresponding profile 21, such as for instance cooperating tongues and grooves.

Figure 1E:
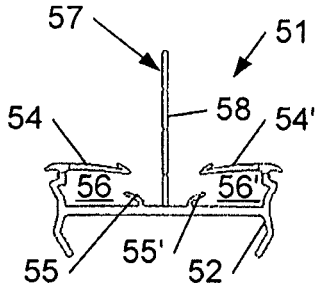
Figure 1B:
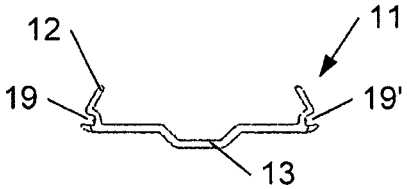
Figure 1F:
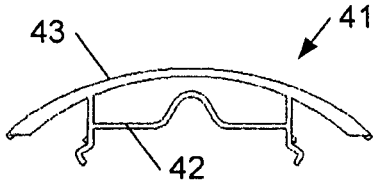
Figure 1C:
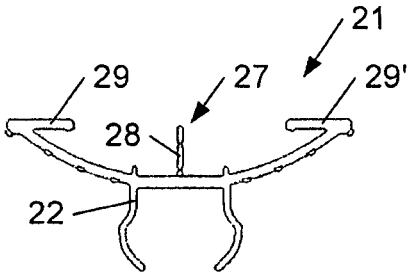

The corresponding profile 21 which is used in FIGS. 2, 3 and 6 is shown in itself in FIG. 1C. This profile further comprises a flexible lip 27 in the middle, connected to its mounting member 22 and provided for closing off the gap between the corresponding profile 21 and the closing profile 1. The length of the flexible lip 27 is such that it touches the back side of the mounting member 2 of the closing profile 1 as is shown on FIGS. 2, 3 and 6. This flexible lip 27 of the corresponding profile 21 may also comprise a plurality of tearable strips 28 connected to each other by weak portions providing in an easy way to adjust the length of the flexible lip 27, in a similar way as has been described for the closing profile 1 of FIG. 1A.

In FIGS. 4, 5 and 7 the first door assembly member 92, to which the closing profile 1 is mounted, is a rotatable door. In these figures it is shown that the closing profile 1 is directly mounted on a reveal part of the door, the reveal part being a vertical edge part of the door as is shown in FIGS. 4 and 5, or a horizontal edge part of the door as is shown in FIG. 7. The reveal part is provided with protrusions complementary to the recesses 9, 9' in the mounting member 2 of the closing profile 1, so that the closing profile 1 can be snap-fitted onto the reveal part.

In FIGS. 2-5, the second door assembly member 93, with which the closing profile 1 cooperates to hold the door in closed position, is formed by an edge profile 11 mounted on the horizontal or vertical door edge. This edge profile 11 is shown in detail in FIG. 1B and comprises a trapezoidal protrusion 13, which is in use contacted by the sloping end parts 5, 5' of the wings 4, 4' of the closing profile 1. So this trapezoidal protrusion 13 forms a sealing member of the edge profile 11. However, any other shape ought suitable by the person skilled in the art may be also used instead of the trapezoidal shape, for instance a parabolic shape. The trapezoidal protrusion 13 is provided on a mounting member 12 with recesses 19 on opposite ends to enable the edge profile 11 to be snap-fitted on the reveal part of the door edge. The shape of the mounting member 12 of the edge profile 11 corresponds to that of the mounting member 2 of the closing profile 1, so that they are in fact interchangeable. For example in figures 4 and 5 it is clear that if the edge profile 11 and the closing profile 1 are switched places, the result would be the same. However any other means ought suitable by the person skilled in the art may be used for fixing the edge profile 11 to members of the door assembly, for instance a protrusion on opposite ends of the edge profile which fits in corresponding openings of the door.

In FIGS. 6 and 7, the second door assembly member 93, with which the closing profile 1 cooperates to hold the door in closed position, is formed by an edge 94 of a glass door and a fixed panel above the door. Remark that the trapezoidal shape of the edges of the glass door and fixed panel corresponds to the trapezoidal shape of the edge profile 11 of FIG. 1B, which is an advantage of using the trapezoidal shape in the edge profile 11.

In general, it is preferred that the circumferential profiles 1, 11, 21, 31, 41, 51 of FIG. 1 are symmetric profiles. For example for the closing profile 1 of FIG. 1A, the symmetric shape is an easy way to provide the same hollow space 6, 6' between the first wing 4 and the mounting member 2 on the one hand and the second wing 4' and the mounting member 2 on the other hand, which has the advantage as described above. Furthermore, a symmetric profile has the advantage that substantially the same force has to be exerted on the door to open it in directions A and B. A symmetric profile also has the advantage that it is easier to fabricate and to mount. A symmetric profile also has a positive effect on the aesthetic appearance of the door.

Figure 1D:
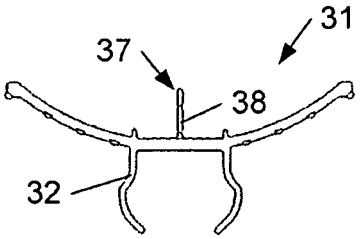
Figure 2A:
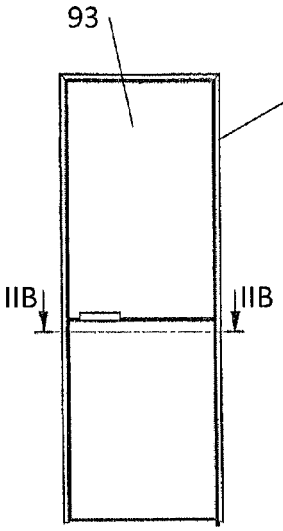
FIG. 2 shows a cross section of a 2-way closing profile according to the present invention provided in a vertical door frame which cooperates with a corresponding edge profile provided in a vertical edge of a door.
Figure 2B:
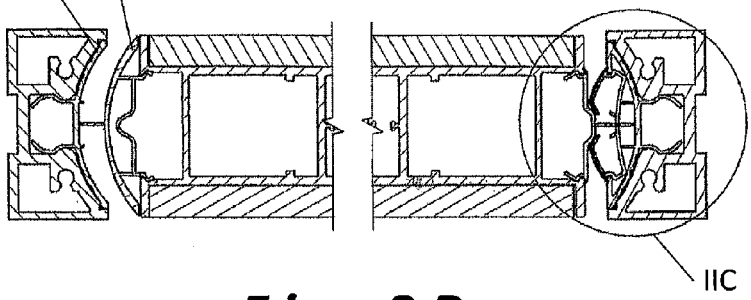
Figure 2C:
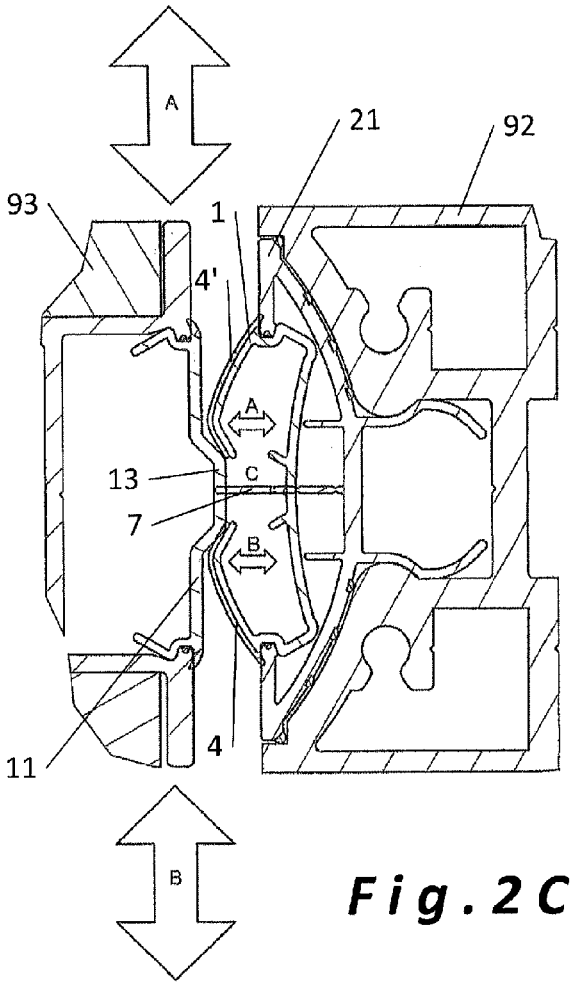

FIG. 2 shows the closing profile 1 of FIG. 1A applied in a 2-way door assembly. A front view of the door assembly is shown in FIG. 2A, as well as a horizontal cross-section in FIG. 2B and a detail on the side of the closing profile 1 in FIG. 2C. It is clearly shown how in the closed position the trapezoidal protrusion 13 of the edge profile 11, which is mounted onto the door 93, fits in the flexible member 3 of the closing profile 1, which is mounted onto the door frame 92. The wings act with their sloping end parts 5, 5' on the slanting sides of the trapezoidal protrusion 13 to maintain the closed position. The flexible lip 7 of the closing profile 1 contacts the top side of the trapezoidal protrusion 13 to provide a third optical seal which avoids penetration of light through the gap on this side of the door. When a force is applied to open the door in direction A, only the second wing 4' is deformed and pushed towards the mounting member 2 of the closing profile 1. When a force is applied to open the door in direction B, only the first wing 4 is deformed and pushed towards the mounting member 2 of the closing profile 1. On the back side of the door, the gap towards the wall opening is closed off by means of the profiles 31, 41 shown in FIGS. 1D and 1F (see below).

Figure 3A:
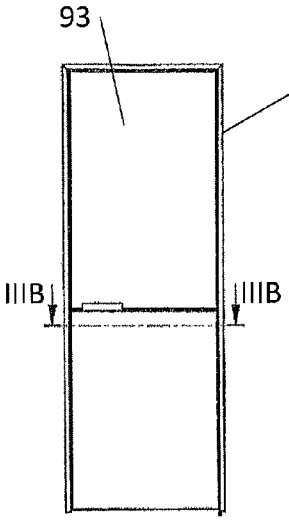
FIG. 3 shows a cross section of a 1-way closing profile according to the present invention provided in a vertical door frame which cooperates with a corresponding edge profile provided in a vertical edge of a door.
Figure 3B:
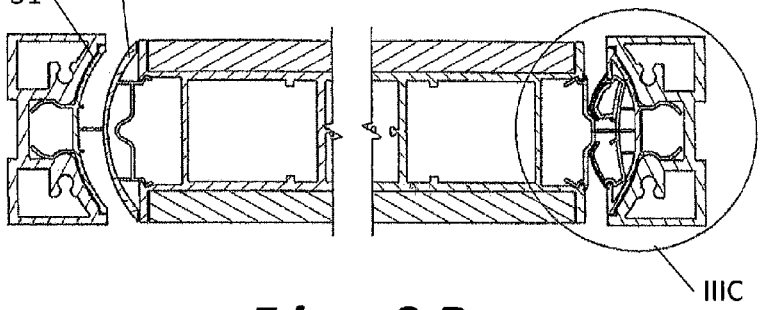
Figure 3C:
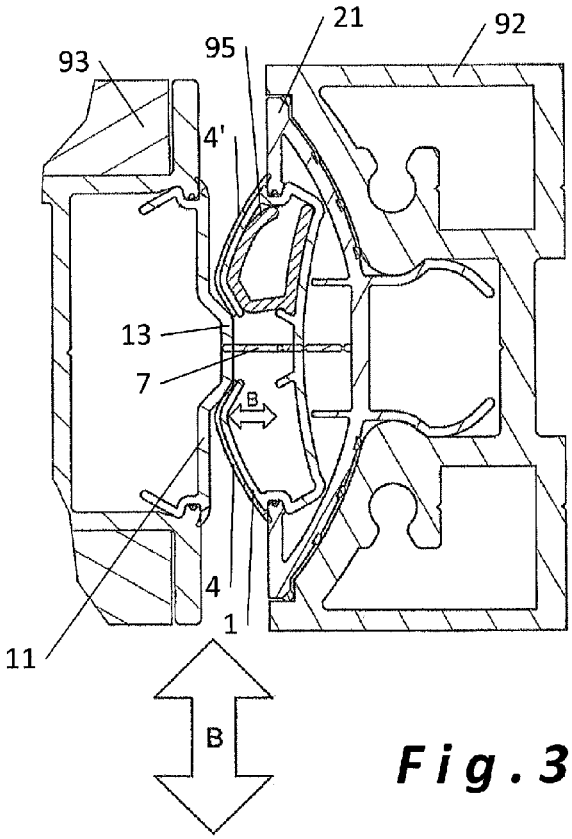

FIG. 3 shows the closing profile 1 of FIG. 1A applied in a 1-way door assembly. A front view of the door assembly is shown in FIG. 3A, as well as a horizontal cross-section in FIG. 3B and a detail on the side of the closing profile 1 in FIG. 3C. The application of FIG. 3 is in fact the same as that of FIG. 2, with the difference that a blocking part 95 has been inserted in the space 6' between the second wing 4' and the mounting member 2 of the closing profile 1. Because of this blocking part 95, the door can only be opened in one direction, i.e. the direction towards the arrow B. Rotation of the door in the other direction is prevented because the complementary edge part 13 of the edge profile 11 is blocked by the second wing 4' which is prevented from bending by the blocking part 95.

In order to convert the application of FIG. 2 to FIG. 3, it is sufficient to place the blocking part 95 in the closing profile 1. There is no need to remove the closing profile 1 and replace it with another closing profile. As a result, the conversion can be done easily by the user himself at any time, since no special technical knowledge or personal assistance is needed for this. Another advantage is that the door, after switching from a 2-way door to a 1-way door, can be opened with exerting the same force as before. The reason for this is that the two wings 4, 4' are bendable independently from each other and that the wing 4 which is not blocked by the blocking part 95 remains unchanged after placing the blocking part 95.

Figure 4A:
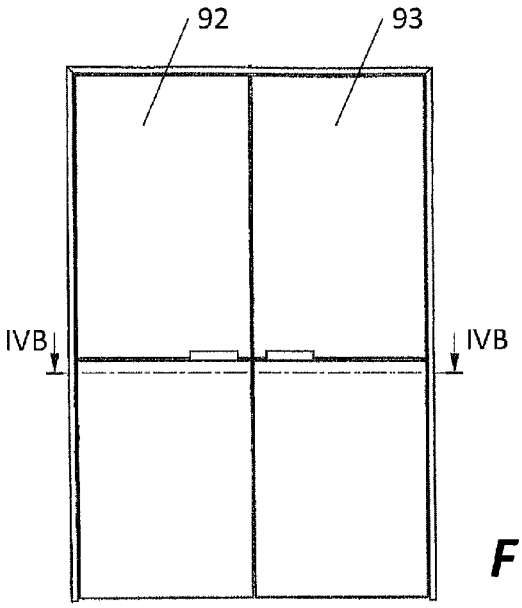
FIG. 4 shows a cross section of a 2-way closing profile according to the present invention provided in a vertical edge of a door which cooperates with a corresponding edge profile provided in a vertical edge of an adjacent door.
Figure 4B:
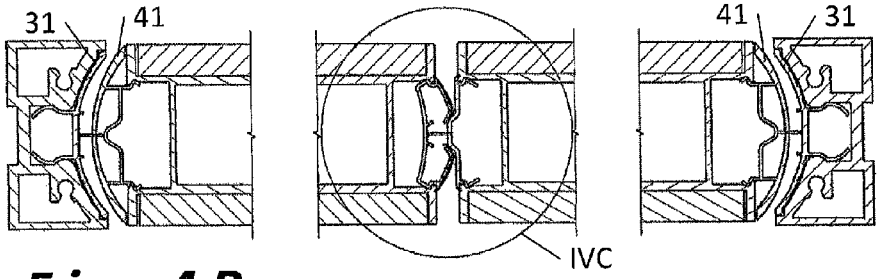
Figure 4C:
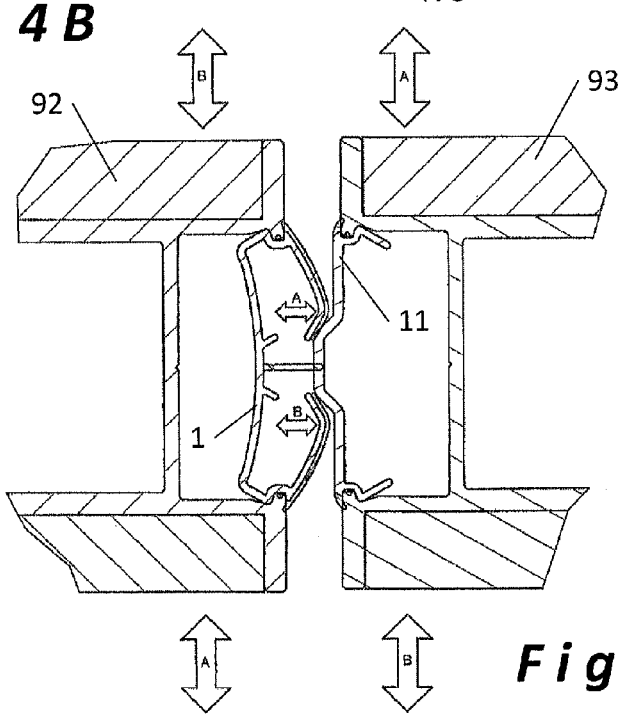

FIG. 4 shows the closing profile 1 of FIG. 1A applied in a 2-way double door assembly. A front view of the double door assembly is shown in FIG. 4A, as well as a horizontal cross-section in FIG. 4B and a detail on the side of the closing profile 1 in FIG. 4C. It is clearly shown how in the closed position the trapezoidal protrusion 13 of the edge profile 11, which is mounted onto one of the doors, fits in the flexible member 3 of the closing profile 1, which is mounted onto the other door. On the back side of each of the doors, the gap towards the wall opening is again closed off by means of the profiles 31, 41 shown in FIGS. 1D and 1F (see below).

Figure 5A:
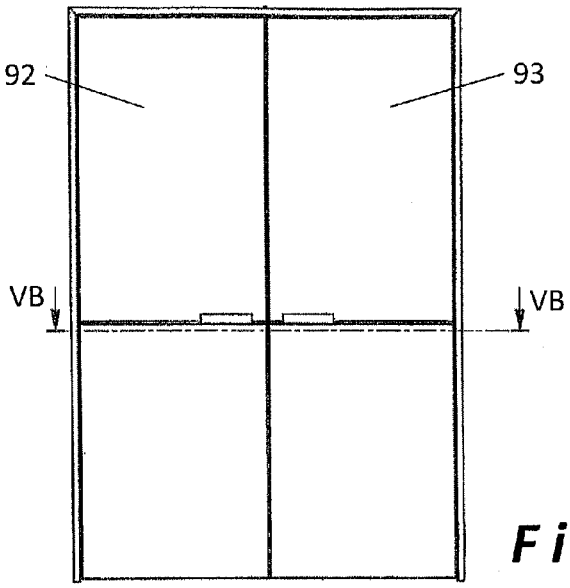
FIG. 5 shows a cross section of a 1-way closing profile according to the present invention provided in a vertical edge of a door which cooperates with a corresponding edge profile provided in a vertical edge of an adjacent door.
Figure 5B:
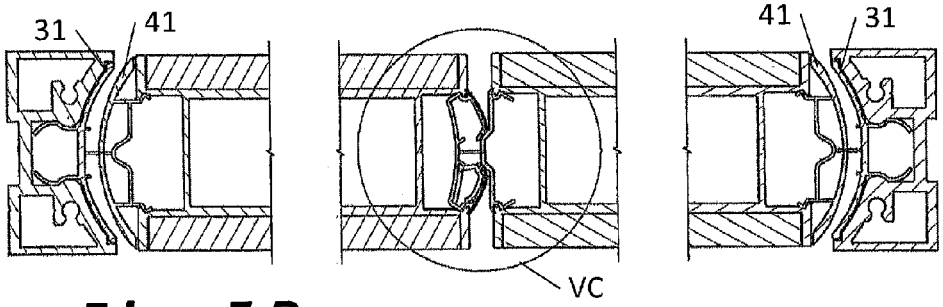
Figure 5C:
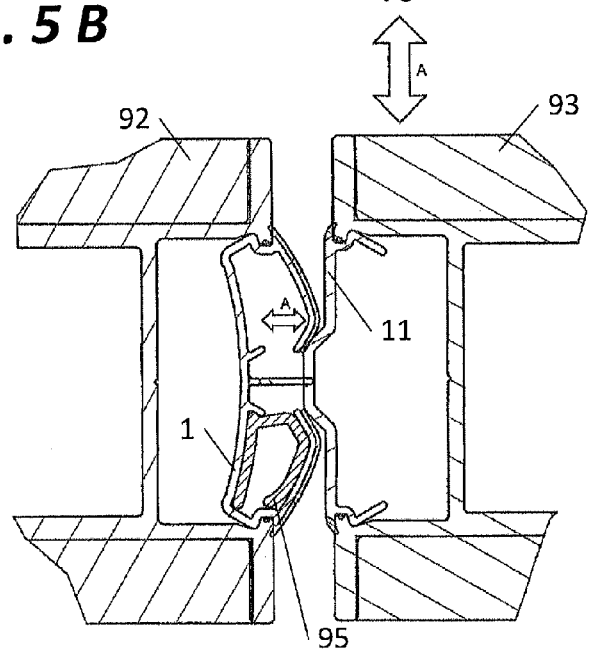

FIG. 5 shows the closing profile 1 of FIG. 1A applied in a 1-way double door assembly. A front view of the double door assembly is shown in FIG. 5A, as well as a horizontal cross-section in FIG. 5B and a detail on the side of the closing profile 1 in FIG. 5C. The application of FIG. 5 is in fact the same as that of FIG. 4, with the difference that a blocking part 95 has been inserted in the space 6' between the second wing 4' and the mounting member 2 of the closing profile 1, with the same effects as have been described above with respect to FIG. 3.

Figure 6A:
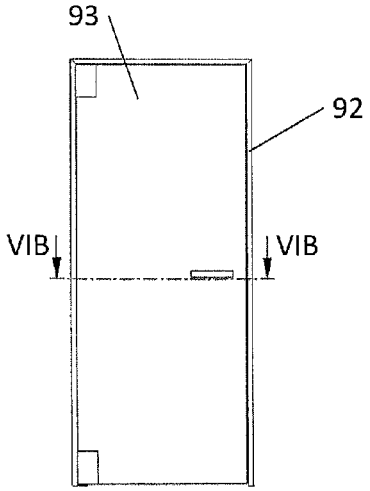
FIG. 6 shows a cross section of a 2-way closing profile according to the present invention provided in a vertical door frame which cooperates with a corresponding vertical edge of a glass door.
Figure 6B:
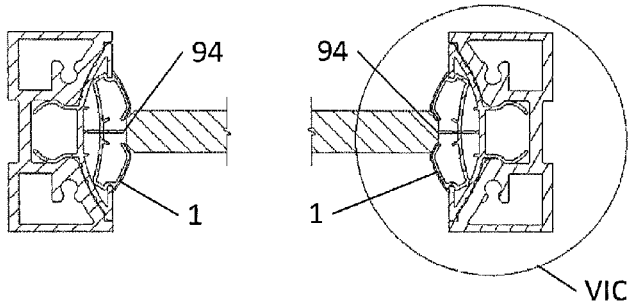
Figure 6C:
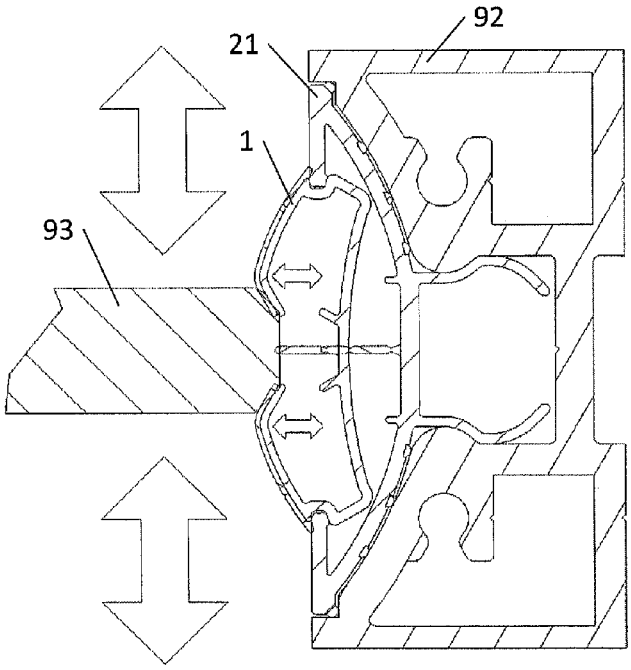

FIG. 6 shows the closing profile of FIG. 1A applied in a 2-way door assembly. A front view of the door assembly is shown in FIG. 6A, as well as a horizontal cross-section in FIG. 6B and a detail of the closing profile 1 on one side of the door in FIG. 6C. It is clearly shown how, on each side of the doors, the trapezoidal edge 94 of the door fits in the flexible member 3 of the closing profile 1, which is mounted onto both sides of the door frame and also in the top side.

FIG. 7 shows the closing profile 1 of FIG. 1A applied in a door assembly with a fixed plate above the door. A front view of the door assembly is shown in FIG. 7A, as well as a vertical cross-section in FIG. 7B and a detail on the side of the closing profile 1 in FIG. 7C. It is clearly shown how a lower trapezoidal edge of the plate fits in the flexible member of the closing profile 1 which is mounted on an upper edge part of the door. The gap between the lower edge part of the door and the floor is closed off by means of the profile 51 shown in FIG. 1E (see below).

Figure 8A:
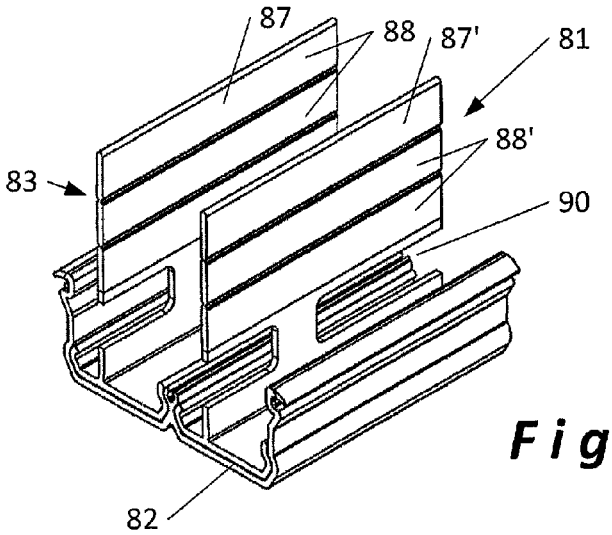
Figure 8B:
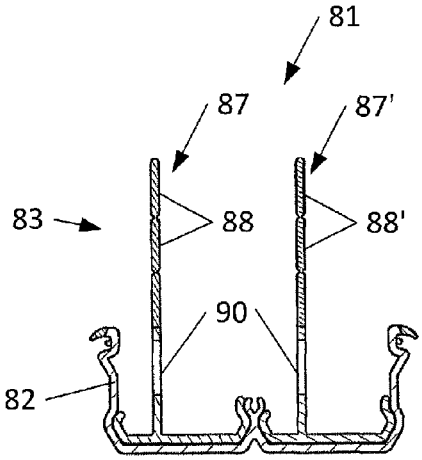
Figure 8C:
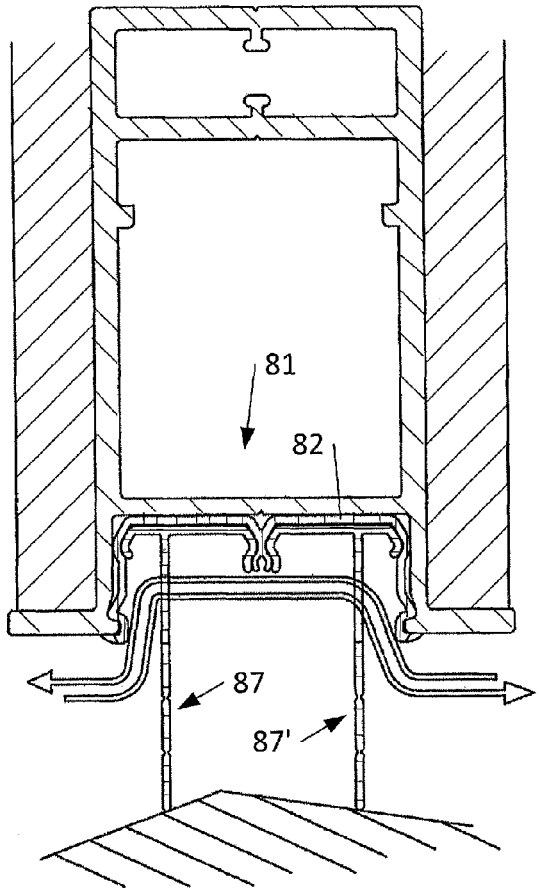

FIGS. 8A and 8B show a detailed view of a first preferred embodiment of a circumferential profile 81 according to the invention. The circumferential profile 81 comprises a mounting member 82 with which it is mounted to a reveal part of a door or a door frame. Usually, the circumferential profile 81 is mounted to a lower horizontal reveal edge part of the door as is shown in FIG. 8C to optically close the gap at the bottom side. However, the circumferential profile 81 may be mounted on any reveal part of the door or door frame ought suitable by the person skilled in the art. The circumferential profile 81 further comprises a sealing member 83 for optically closing the gaps between the door and the floor here constructed as two separate parts which are snap-fitted in the mounting member 82. The sealing member 83 comprises two flexible lips 87, 87', which are connected to the mounting member 82. Each of the flexible lips 87, 87' has a length such that it contacts the floor. Each of the flexible lips 87, 87' is divided in a lower part extending between the lower side of the door and the floor and visible from outside, and an upper part hidden in the mounting member 82 and invisible from outside. The lower part of the flexible lips 87, 87' is made in an opaque flexible material such that light cannot shine trough it. The integrated ventilation system 90 is provided in the upper part of the flexible lips 87, 87' by means of perforations. Air can flow from one room through the perforations 90 to another room as is shown in FIGS. 8C and 9A-9C. Preferably, at least one of the two flexible lips 87, 87' comprises a plurality of tearable strips 88, 88' connected to each other by weak portions. The length of the flexible lips can then be adjusted in an easy way by simply tearing of one or more of the strips 88, 88'.

Figure 7B:
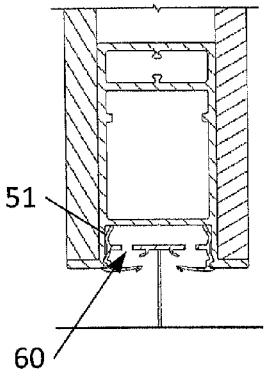

FIG. 1E shows a detailed view of a second preferred embodiment of a circumferential profile 51 according to the invention. FIG. 7B shows the circumferential profile 51 of FIG. 1E applied in a door assembly. The circumferential profile 51 shown in FIG. 1E comprises a mounting member 52 with which it is mounted to a lower horizontal reveal part of a door as is shown in FIG. 7B. However, the circumferential profile 51 may be mounted on any reveal part of the door or door frame ought suitable by the person skilled in the art. The circumferential profile 51 shown in FIG. 1E further comprises a sealing member 57 for optically closing the gaps between the door and the floor. The sealing member 57 comprises a flexible lip which is connected to the mounting member 52. The flexible lip has a length such that it contacts the floor. The flexible lip comprises a plurality of tearable strips 58 connected to each other by weak portions provided for adjusting the length of the flexible lip. The circumferential profile 51 further comprises two flexible wings 54, 54', provided on each side of the flexible lip and bendable towards the mounting member 52. By bending the two flexible wings 54, 54', they can be clicked behind a protrusion 55, 55' provided on the inside of the mounting member 52. In this circumferential profile 51, the integrated ventilation system 60 can be provided in its mounting member 52 or in its flexible lip. The circumferential profile 51 provided with an integrated ventilation system 60 in its mounting member 52 is shown in FIG. 7C. Perforations are made in the mounting member 52 on both sides of the flexible lip. Air can flow from one room, through the open space 56 between the first wing 54 and the mounting member 52, through the perforations on a first side of the flexible member, through the open space between the mounting member 52 and the lower side of the door, through the perforations on a second side of the flexible member, through the open space 56' between the second wing 54' and the mounting member 52, to the other room. Moreover, air flow can be avoided, by simply clicking one or both wings 54, 54' behind the protrusions 55, 55' on the mounting member 52. Because the perforations are provided in the mounting member, they are hidden and invisible from the outside. It is also possible to provide the integrated ventilation system 60 in an upper part of the flexible lip hidden in the door. Air can flow through the perforations from one room to another in the same way as explained above in the first preferred embodiment of the circumferential profile 81.

Figure 10A:
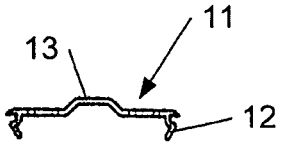
FIGS. 10 and 11 show an integrated ventilation system provided in the mounting member of a circumferential profile of a door assembly according to the present invention.
Figure 10B:
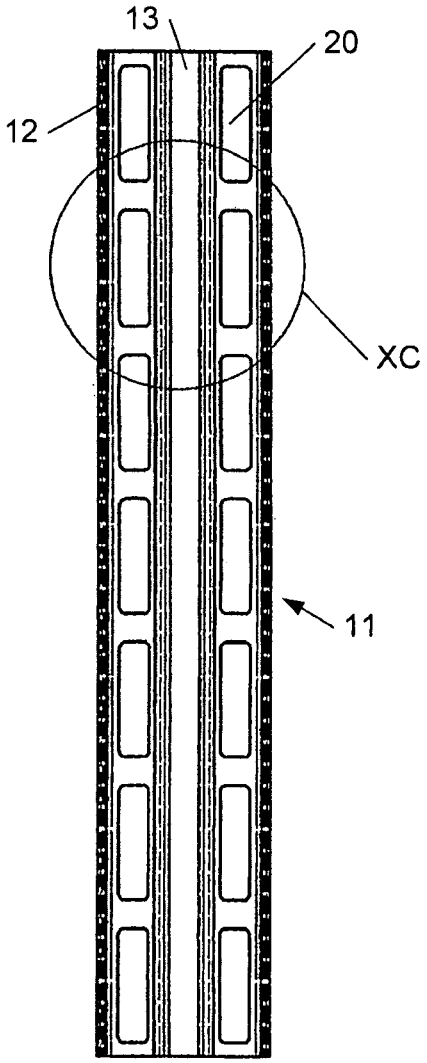
Figure 10C:
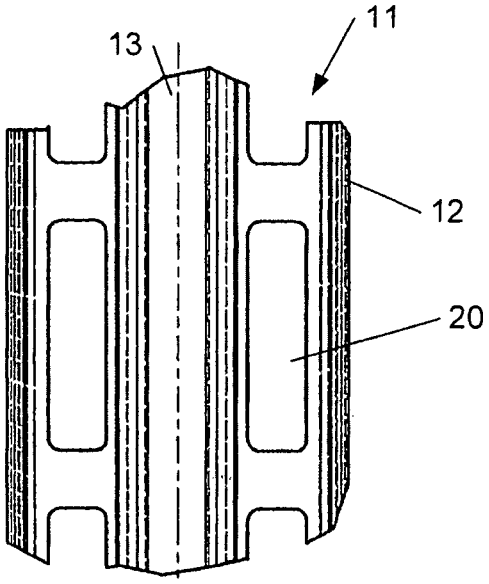
Figure 11A:
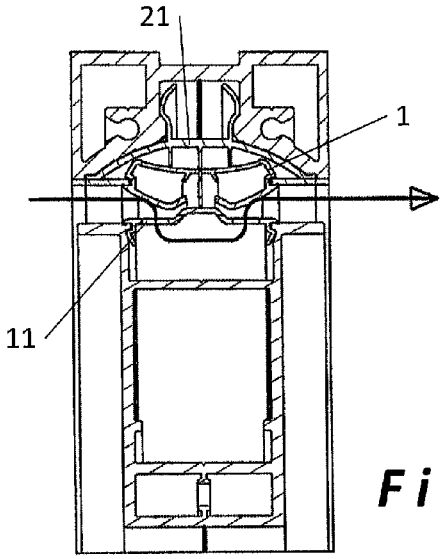
Figure 11B:
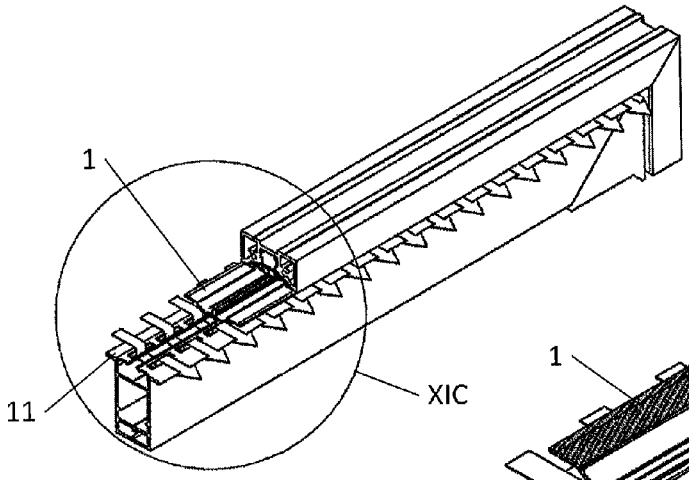
Figure 11C:
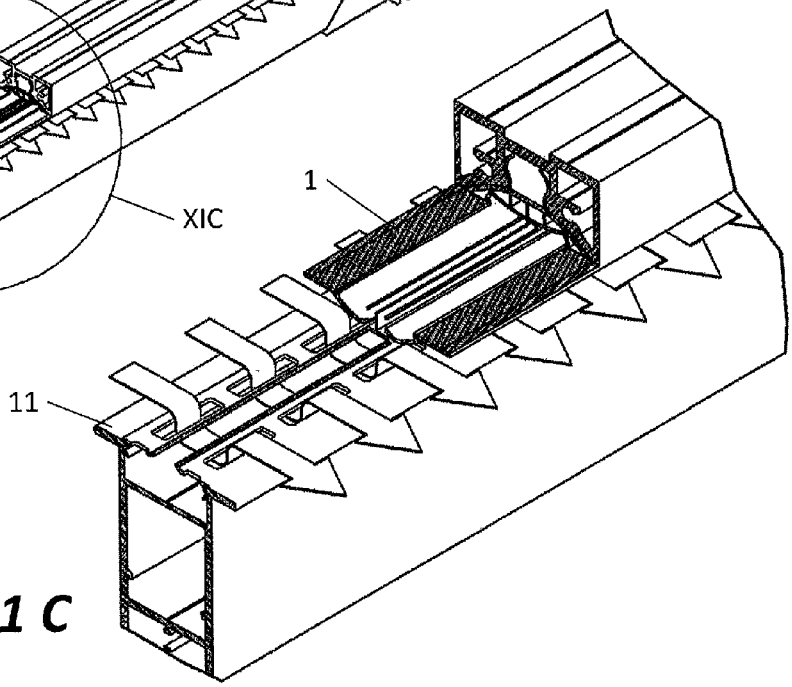

FIG. 10 shows a third preferred embodiment of a circumferential profile 11 according to the invention. A cross section of the circumferential profile 11 is shown in FIG. 10A. A top view of the circumferential profile 11 as well as a detail thereof is shown in respectively FIGS. 10B and 10C. FIG. 11 shows the circumferential profile 11 applied in a door assembly. A vertical cross section of the door assembly is shown in FIG. 11A. A side view of the circumferential profile 11 and a detail thereof is shown in respectively FIGS. 11B and 11C. The circumferential profile 11 shown in FIG. 11A is an edge profile as is shown in FIG. 1B, which additionally comprises an integrated ventilation system 20. The circumferential profile comprises a mounting member 12 with which it is mounted to a reveal part of a door. However, the circumferential profile 11 may also be mounted on a reveal part of the door frame. The sealing member of the circumferential profile 11 comprises a trapezoidal protrusion 13 which is provided for optically closing off gaps between the circumferential profile 11 and the closing profile 1 according to a first aspect of the invention which is mounted in an edge part of a door frame. Ventilation is made possible by means of perforations 20 provided in the mounting member of the circumferential profile 11 on both sides of the trapezoidal protrusion 13. This is shown in detail on FIGS. 10B and 10C. In this way air can flow from one room, in particular through the perforations on one side of the trapezoidal protrusion 13, through a space between the mounting member and the door, through the perforations on the other side of the trapezoidal protrusion 13, into the other room, as is shown in FIGS. 11B and 11C. Because the ventilation 20 is integrated in the circumferential profile 11, the ventilation system is invisible from outside and the aesthetic view of the door remains unchanged.

FIG. 1D shows a detailed view of a fourth preferred embodiment of a circumferential profile 31 according to the invention. FIGS. 2-5 show the circumferential profile 31 applied in a door assembly. The circumferential profile 31 in shown in FIG. 1D comprises a mounting member 32 with which it is mounted to a reveal part of a door or a door frame. Usually, the circumferential profile is mounted to a reveal part of a door frame on the hinge side of the door as is shown in FIG. 2B. However, the circumferential profile may also be mounted on a reveal part of the door. The circumferential profile further comprises a sealing member 37 for optically closing the gaps between the door and the door frame. The sealing member 37 comprises a flexible lip which is connected to the mounting member 32. The flexible lip has a length such that it contacts a complementary edge part 43 of an edge profile 41. A preferred embodiment of such an edge profile 41 as shown in FIG. 1F. The edge profile 41 as shown in FIG. 1F comprises a mounting member 42 through which it is mounted on a reveal part of a door as is shown in FIG. 2B. The complementary edge part 43 of the edge profile 41 has a convex shape, which cooperates with the concave shape of the mounting member 32 of the circumferential profile 31. This system provides for a very safe opening and closing of the door, because when opening the door, fingers can not be pressed between the edge profile 41 and the circumferential profile 31. In case it is desired, the circumferential profile 31 can comprise an integrated ventilation system 40. This ventilation system 40 can be provided by means of perforations provided in the mounting member 32 provided on both sides of and in the vicinity of the flexible lip 37. Air can flow from one room, through the perforations on one side of the flexible lip 37, through the open space between the mounting member and an edge part of the door frame, through the perforations on the other side of the flexible lip 37, to the other room.

Figure 12:
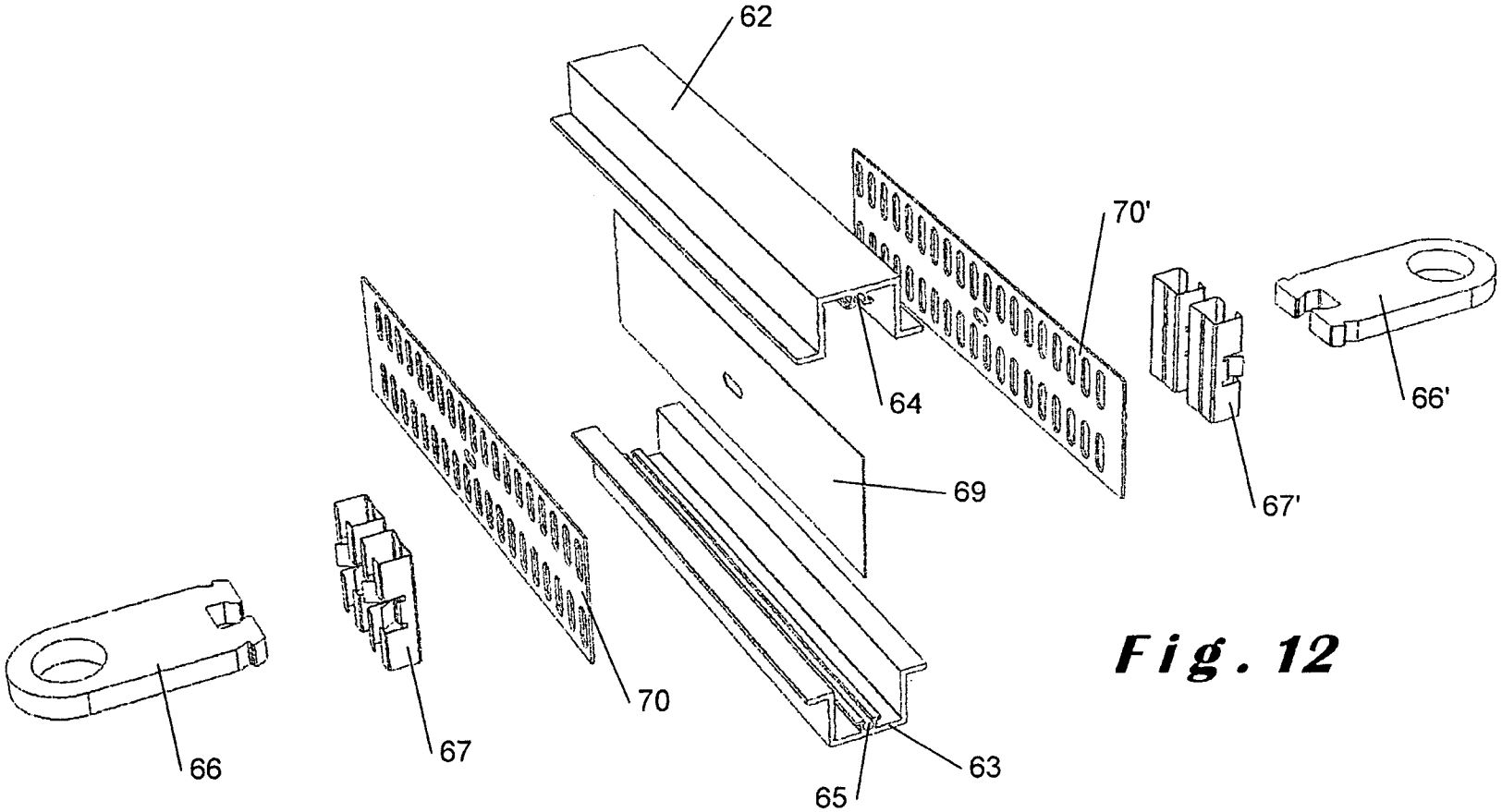
FIGS. 12-14 show an insert-grab ventilation system provided in an oblong grid profile of a door assembly according to the present invention.
Figure 13B:
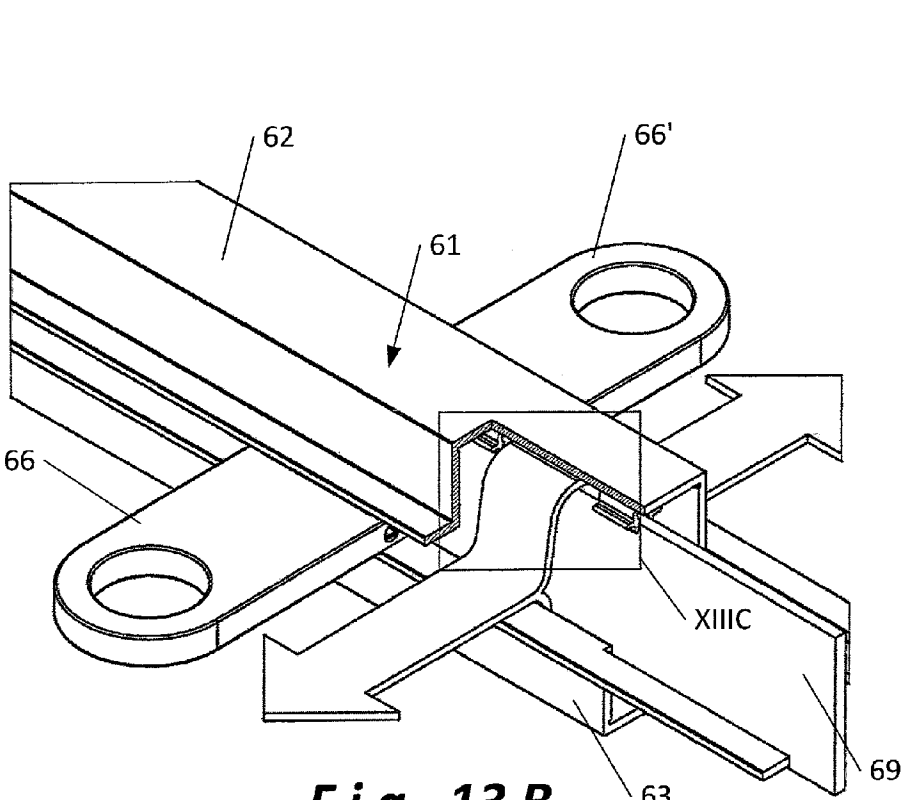
Figure 13A:
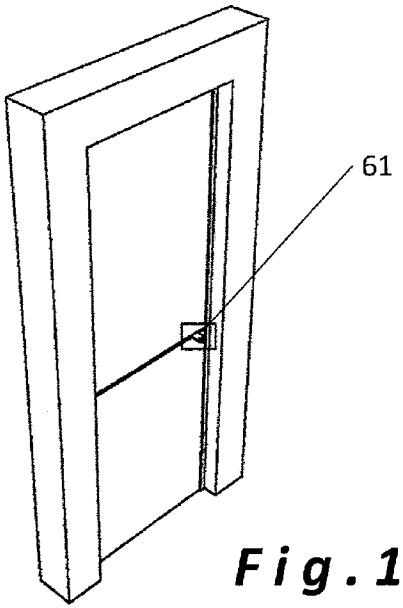
Figure 13C:
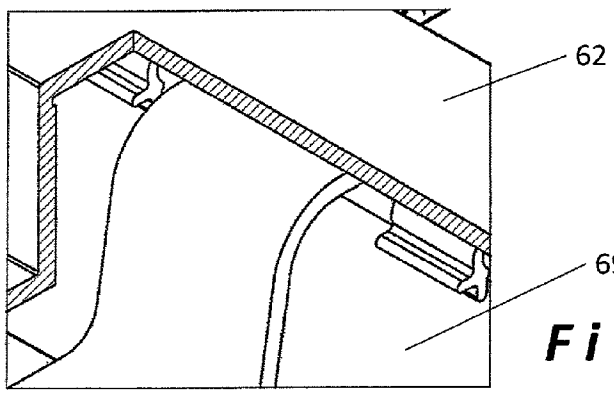
Figure 14A:
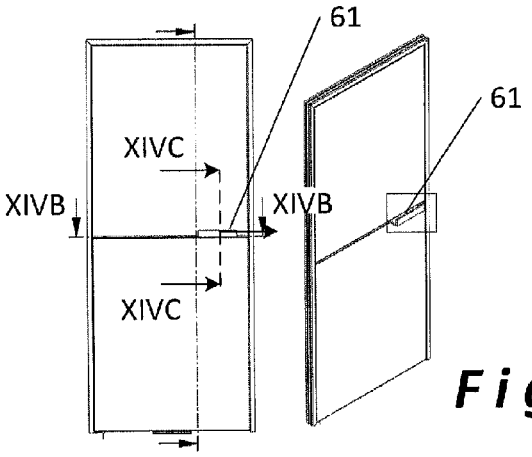
Figure 14B:
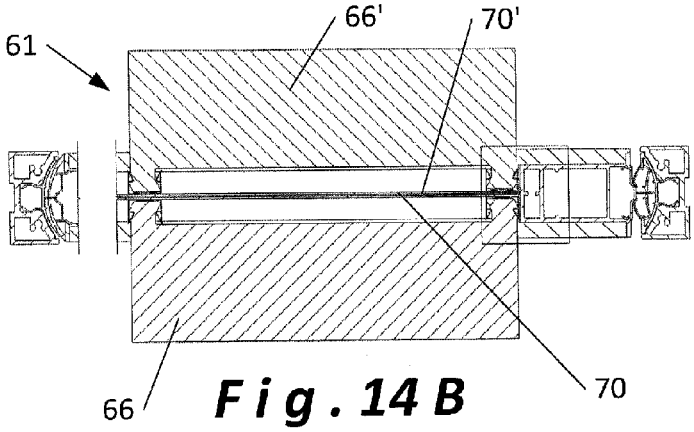
Figure 14C:
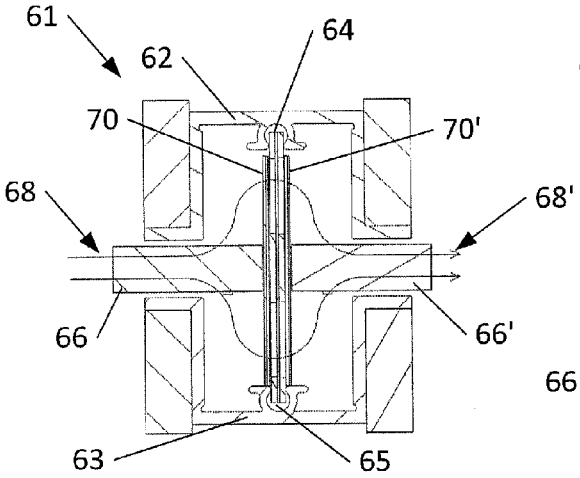
Figure 14D:
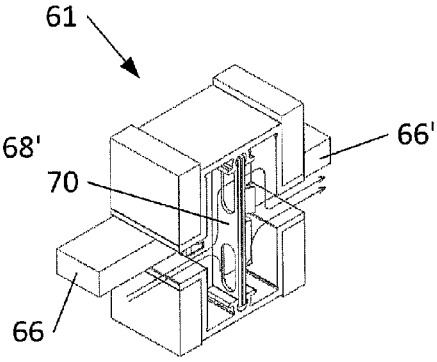

FIGS. 12-14 show a first preferred embodiment of an oblong grip profile 61 according to the invention.

FIG. 12 shows the different parts that are used to build up the oblong grip profile 61 provide with an integrated ventilation system: two grips 66, 66', two grip mounting parts 67, 67' for mounting the grips 66, 66' on the oblong grip profile 61, an upper 62 and lower 63 oblong profile and either a partition 69 or two perforated plates 70, 70'. A door comprising an oblong grip profile 61 provided with an integrated ventilation system is built up using these parts in the following way.

FIGS. 13 and 14 show an oblong grip profile 61 horizontally integrated in a door, the oblong grip profile 61 being provided with an integrated ventilation system and built up using the parts shown in FIG. 12. The upper 62 and lower 63 oblong profile are placed on a certain distance from each other hereby creating a front 68 and back 68' opening. The front 68 and back 68' opening are provided on the same height. Both the front 68 and back 68' opening are narrow at the surface and widen towards the middle of the grip profile. In the front 68 and back 68' opening a grip 66, 66' is mounted on the oblong grip profile 61 with the aid of the grip mounting fasteners 67, 67'. The oblong grip profile 61 extends over substantially the entire width of the door and divides it into an upper door panel segment and a lower door panel segment. These are in turn respectively formed by upper front and back panels and lower front and back panels. The oblong grip profile 61 has stepped portions which each have a portion for contacting a rear side of the panel. Both the upper 62 and lower 63 oblong profile comprises a groove 64, 65 in the middle of the profile. In these horizontally extending grooves 64, 65, either the partition 69 (FIG. 13), or the two perforated plates 70, 70' (FIG. 14) are placed, providing the grip profile 61 with an integrated ventilation system. The partition 69 has a height which is such that a narrow ventilation gap remains at the upper and lower profiles 62, 63. The two perforated plates 70, 70' are mounted such that they are laterally displaceable with respect to each other so that ventilation can be controlled. When the perforations of the plates correspond, the ventilation system is activated. When the perforations of one plate correspond with a non-perforated part of the plate, the ventilation system may be deactivated. Air can flow from one room, through the front opening, through the ventilation gaps above and below the partition 69 or the perforations in the plates 70, 70' and through the back opening to the other room, as is shown in detail on FIGS. 14C and 14D. The perforations in the plates are invisible from outside because they are provided in the vicinity of the upper 62 and lower 63 oblong profiles. This ventilation system is called the insert-grab ventilation system.

Other embodiments of this insert-grab ventilation system are possible. The oblong grip profile 61 may for instance be vertically integrated in the door or in a slanting direction. It is for instance possible to mount only one perforated plate 70 in the horizontally extending grooves 64, 65 of the upper 62 and lower 63 oblong profile. The amount of ventilation can be varied by varying the size of the perforations, by providing perforations only near the upper oblong profile or near both the upper and lower oblong profile, etc. It is possible that no grip 66, 66' is mounted on the oblong grip profile 61. In fact, the oblong grip profile 61 may function in itself as the grip where the door can be opened or closed by placing the hand in the back 68' or front 68 opening of the oblong grip profile 61.

Figure 15A:
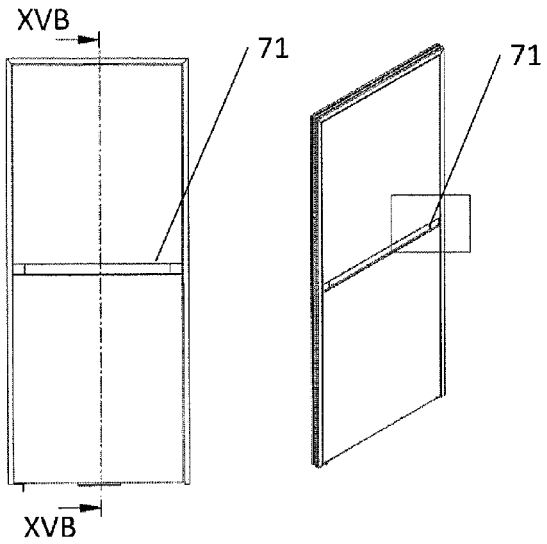
FIG. 15 shows a mailbox ventilation system provided in an oblong grid profile of a door assembly according to the present invention.
Figure 15B:
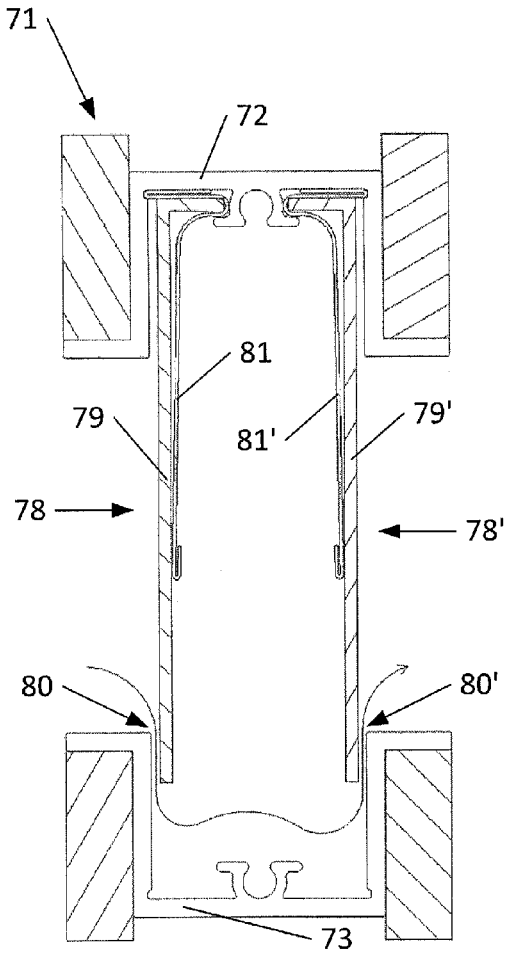
Figure 15C:
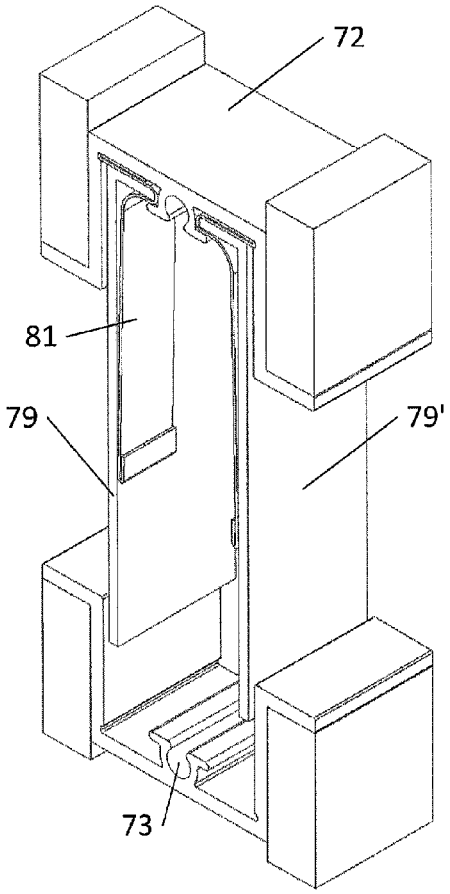

FIG. 15 shows a second preferred embodiment of the oblong grip profile 71 according to the invention. The oblong grip profile 71 is horizontally integrated in a door and is provided with a so called integrated mailbox ventilation system. This is shown in detail on FIG. 15B. The oblong grip profile 71 comprises an upper 72 and lower 73 oblong profile which are placed on a certain distance from each other hereby creating a front 78 and back 78' opening. The front 78 and back 78' openings are provided on the same height. Both the front 78 and back 78' openings are narrow at the surface and widen towards the middle of the grip profile. The oblong grip profile 71 extends over substantially the entire width of the door and divides it into an upper door panel segment and a lower door panel segment. These are in turn respectively formed by upper front and back panels and lower front and back panels. The oblong grip profile 71 has stepped portions which each have a portion for contacting a rear side of the panel. In the upper oblong profile 72 a front 79 and back 79' plate are mounted respectively near the front 78 and back 78' opening. The front 79 and back 79' plate visually close off the front 78 and back 78' opening of the oblong grip profile 71. The plates 79, 79' can be pushed inwards against the action of leaf springs 81, 81' for enabling a user to grab the lower profile 73 at the front 78 or back 78' opening and open or close the door. The plates are mounted in such a way that a permanent minimal gap is present between the oblong profile and the pivotable plates. Air can flow from one room through the gap 80 between the front plate 79 and the lower profile 73, through the gap 80 between the back plate 79' and the oblong grip profile 71, to the other room.

Other embodiments of the mailbox ventilation system are possible. The oblong grip profile may for instance be vertically integrated in the door or in a slanting direction. The partition 69 and perforated plates 70, 70' may be constructed in a luminescent material or provided with luminescent coating to make them glow in the dark.

With reference to FIGS. 16-26, another preferred embodiment of a door assembly according to the invention will now be described.

Figure 16:
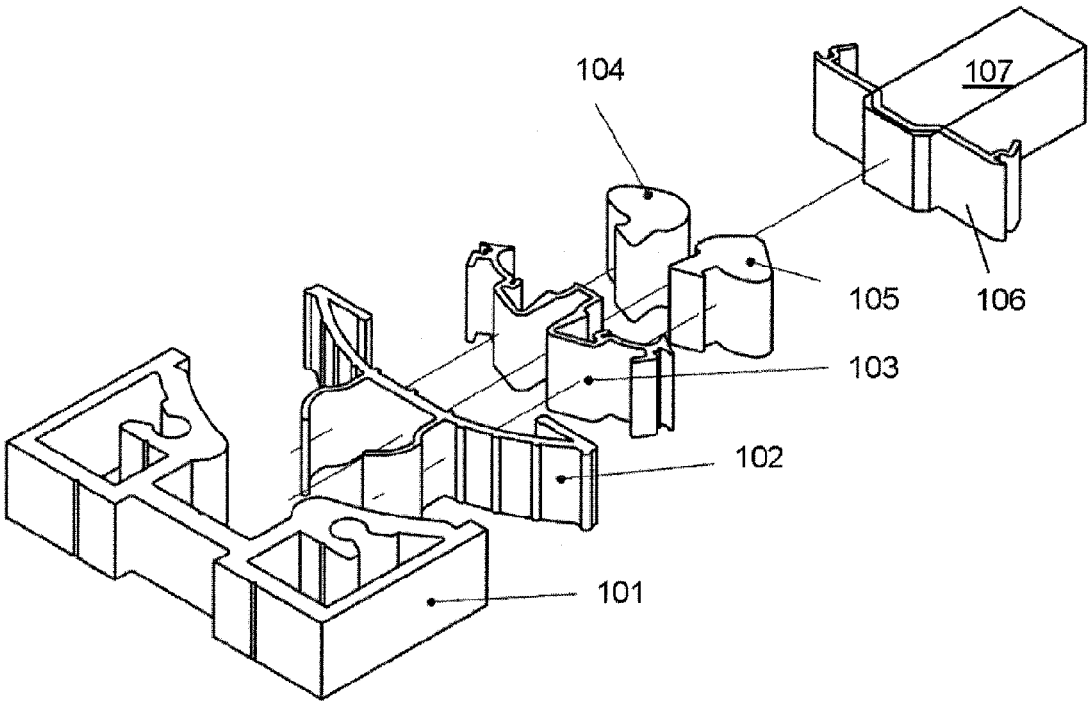
FIG. 16 shows a perspective view of a preferred embodiment of a door assembly according to the invention.
Figure 17:
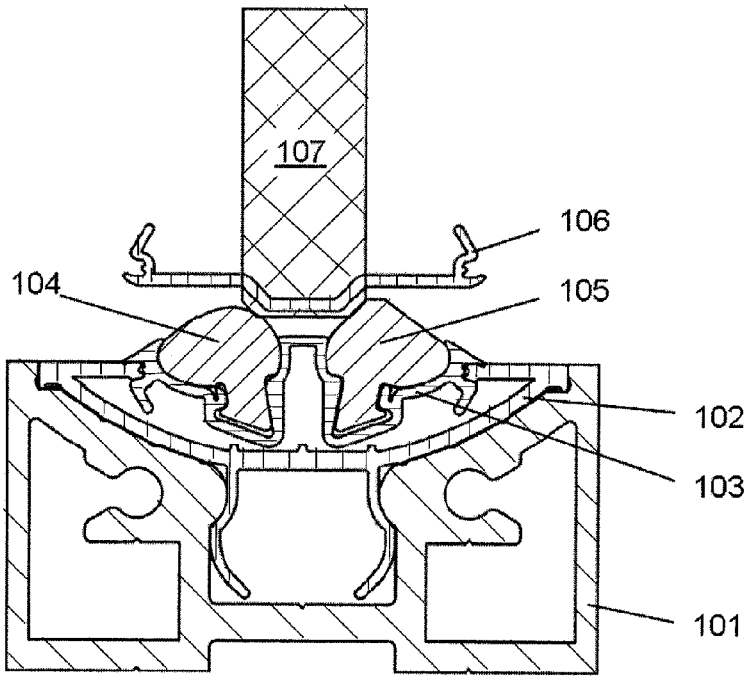
FIG. 17 shows a cross-section of a preferred embodiment of a door assembly according to the invention.

The door assembly shown in FIGS. 16 and 17 comprises a door frame profile 101, an intermediate profile 102 which snaps into the door frame profile 101, a holder profile 103 which snaps into the intermediate profile 102, an engaging strip 104 and a blocking strip 105 which respectively snap into first and second recesses 131, 132 of the holder profile, and a complementary edge part which is either part of an opposite profile 106 or a unitary, for example glass door blade 107 (in FIG. 16 these are drawn on top of each other).

Figure 18:
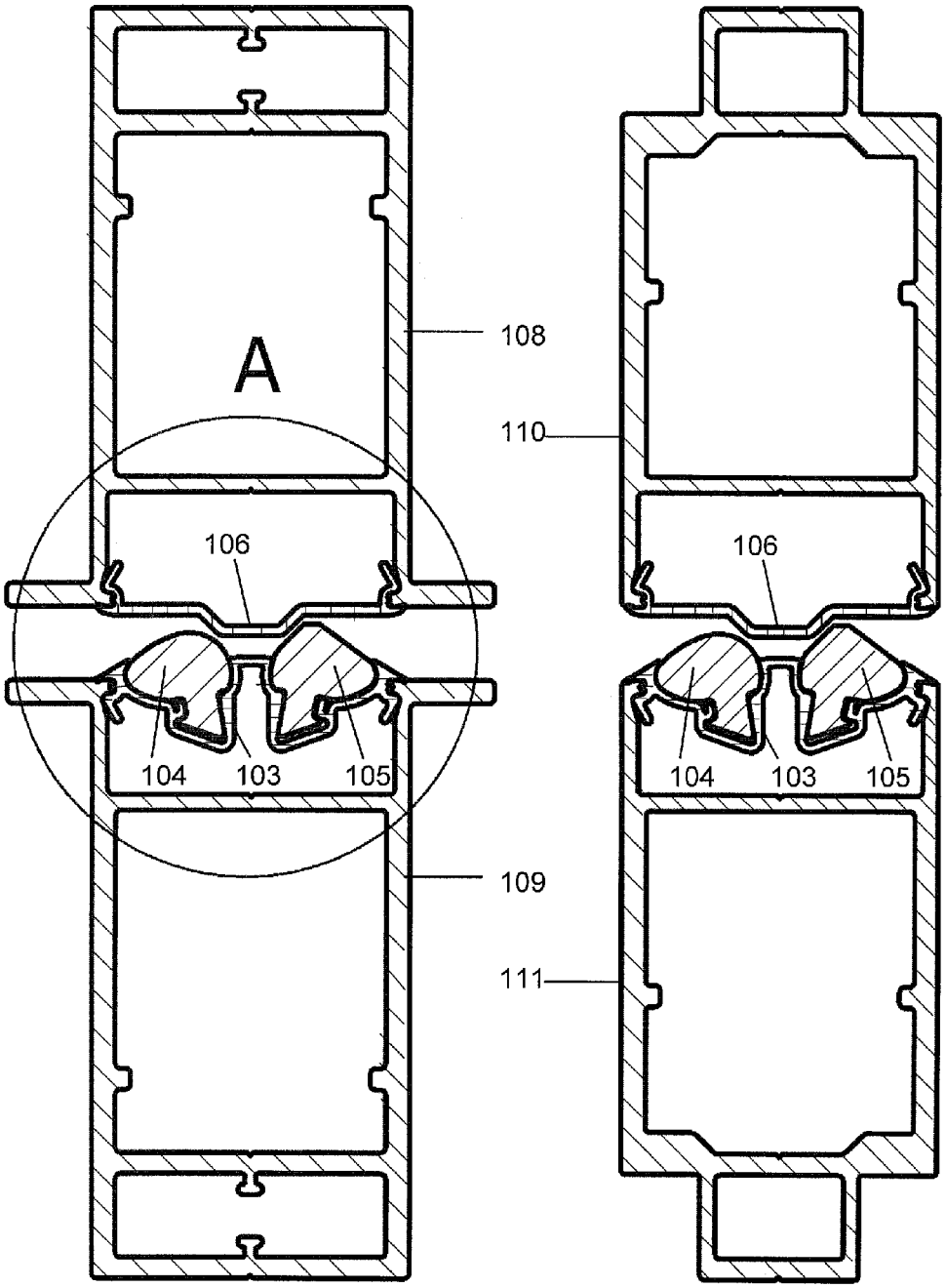
FIG. 18 shows a cross-section of a preferred embodiment of a door assembly according to the invention.
Figure 19:
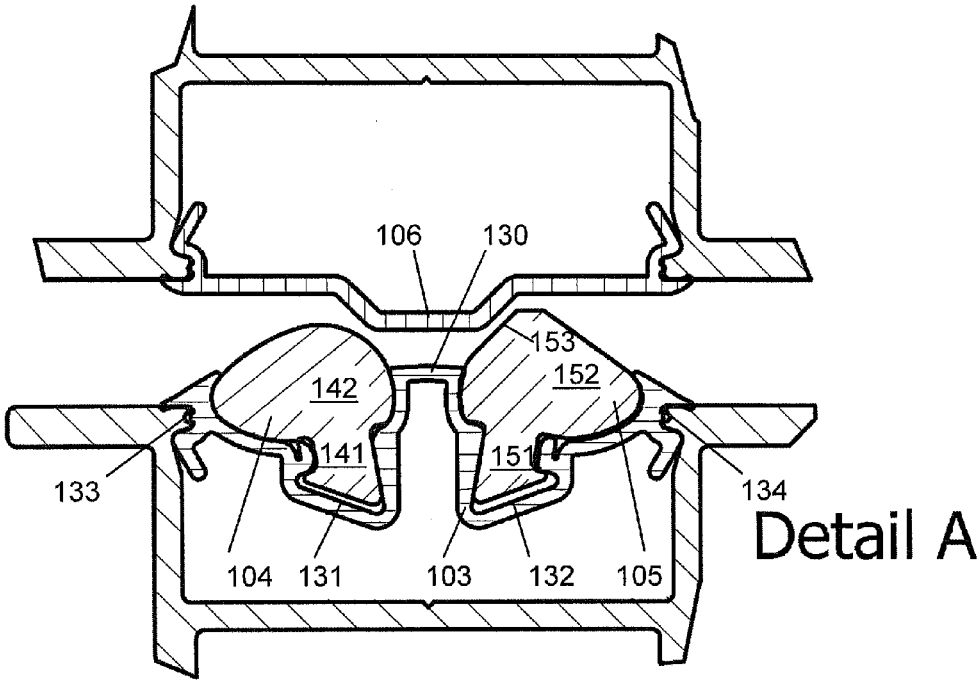
FIG. 19 shows a detail of FIG. 18.

The door assembly shown in FIGS. 18 and 19 comprises two opposite members 108, 109 or 110, 111 which form part of a door assembly with a double door. In this door assembly the same holder profile 103, opposite profile 106 and strips 104 and 105 are applicable as in the door assembly of FIGS. 16 and 17. the holder profile 103, the strips 104 and 105 and the complementary edge part 106/107 together form a closing system which is adapted to maintain the door in closed position and enable opening of the door when the user pushes against the door, by elastic deformation of a part of the closing system, in this case the engaging strip 104.

Figure 20:
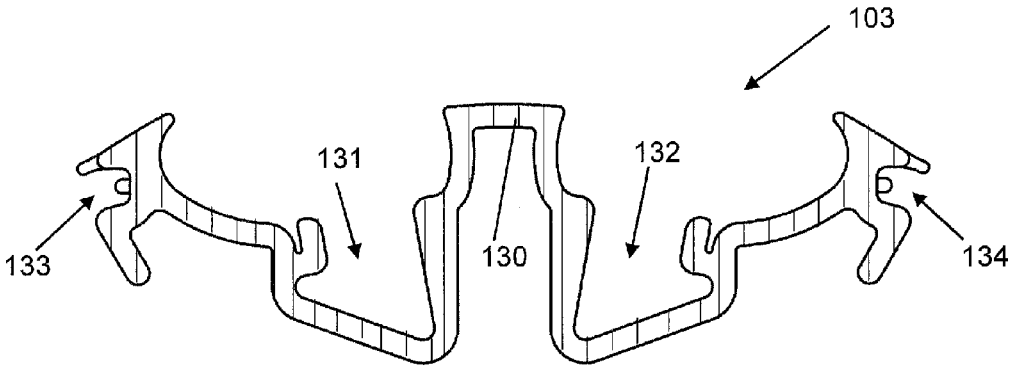
FIG. 20 shows a cross-section of the holder profile of a preferred embodiment of a door assembly according to the invention.
Figure 21:
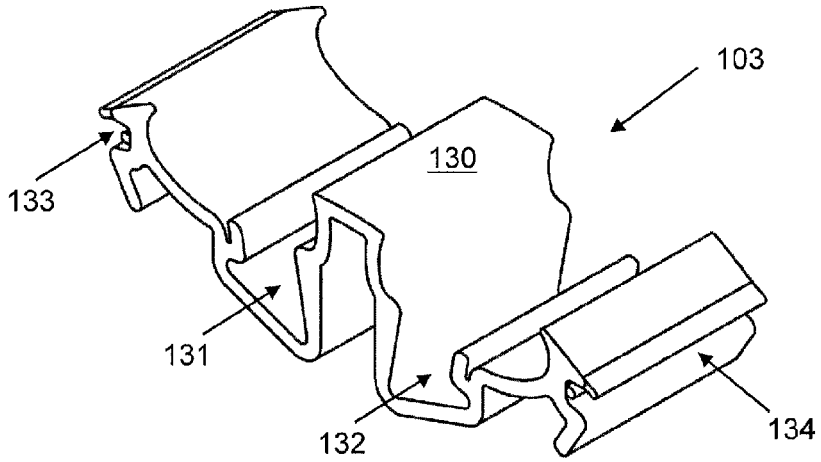
FIG. 21 shows a perspective view of the holder profile of a preferred embodiment of a door assembly according to the invention.
Figure 22:
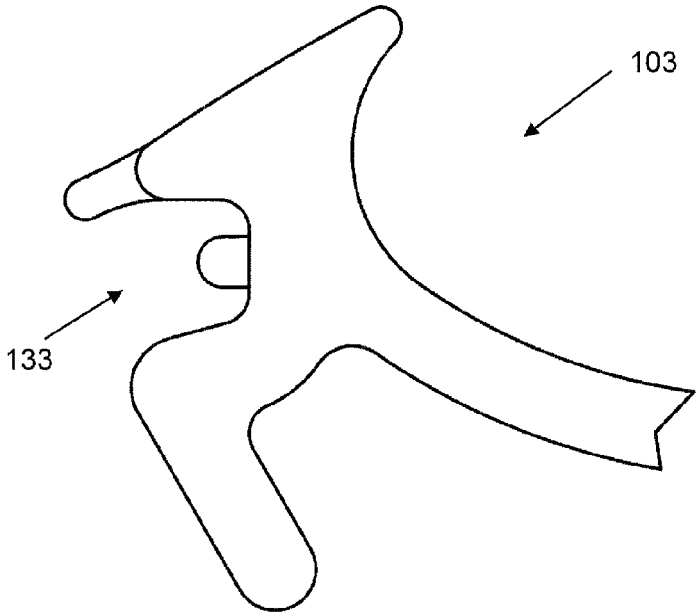
FIG. 22 shows a detail of FIG. 20.
Figure 23:
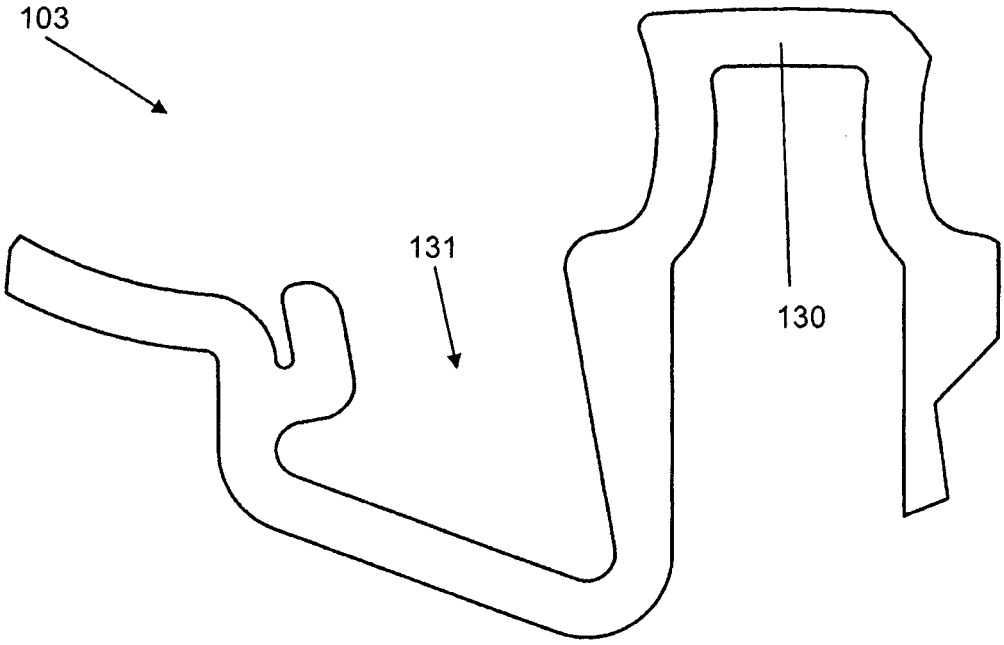
FIG. 23 shows a detail of FIG. 20.

FIGS. 20 and 21 show the holder profile 103. This has a middle part 130 with respectively the first recess 131 and the second recess 132 on opposite sides thereof. The recesses 131, 132 are shaped for accommodating a tooth-shaped part 141, 151 of the engaging and blocking strips 104, 105 which are hereby releasably mountable to the holder profile 103 by means of a snap connection. A detail of the recesses 131, 132 is shown in FIG. 23. At the extreme ends, side recesses 133, 134 are provided for accommodating teeth or complementary parts of the intermediate profile 102 or the opposite members 108, 109 or 110, 111, by which the holder profile is also releasably mountable in these profiles by means of a snap connection. A derail of the side recesses 133, 134 is shown in FIG. 22. It is clear that these holding elements—teeth and recesses 131-132, 133-134—can be switched places in alternative embodiments of the invention.

The recesses 131 and 132 have the same shape, just like the tooth-shaped parts 141, 151 of the strips 104, 105. As a result, the strips are exchangeable.

Figure 24:
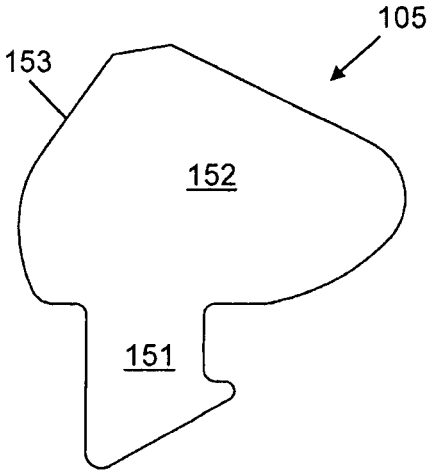
FIG. 24 shows a cross section of a blocking strip of a preferred embodiment of a door assembly according to the invention.
Figure 25:
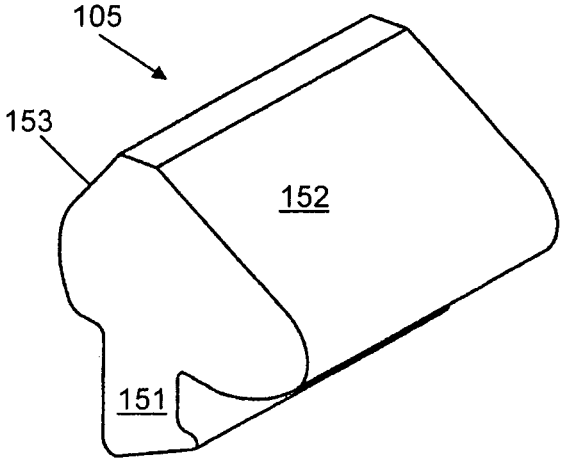
FIG. 25 shows a perspective view of a blocking strip of a preferred embodiment of a door assembly according to the invention.

The blocking strip 105, shown in detail in FIGS. 24 and 25, comprises the tooth-shaped part 151 with which it is releasably mountable in the recesses 131, 132 of the holder part and also a protruding part 152. This protruding part 152 shows an engagement plane 153 which is oriented parallel to a slanting edge on the complementary edge part (see FIG. 17). The blocking strip 105 is a unitary body constructed in a lightly compressible material, so that a soft engagement edge is achieved which dampens the closing movement of the complementary edge part 106, 107 against the blocking strip. The size of the protruding part 152 and the compressibility of the material are chosen such, that the strip 105 prevents the opening of the door in that direction, in other words that the complementary edge part cannot pass by the blocking strip.

Figure 26:
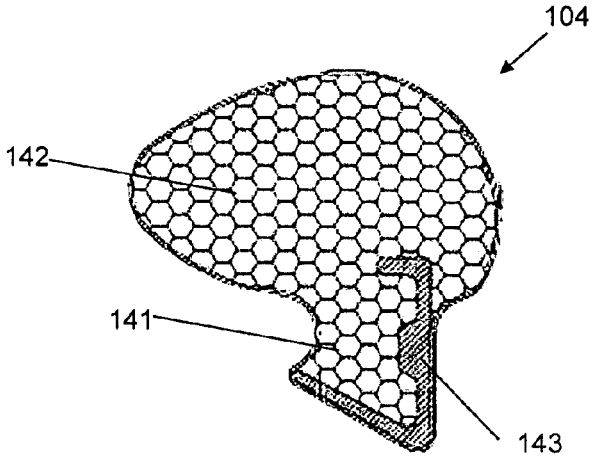
FIG. 26 shows a cross section of an engaging strip of a preferred embodiment of a door assembly according to the invention.

The engaging strip 104, shown in detail in FIG. 26, comprises the tooth-shaped part 141 with which it is releasably mountable in the recesses 131, 132 of the holder part and also a protruding part 142. This protruding part 142 has a rounded shape, of which the size is chosen such that the engaging strip

104 comes into contact with the complementary edge part and maintains the door in the closed position together with the blocking strip 105 (or a second engaging strip 104 in the other recess). The strips 104, 105 on opposite sides of the complementary edge part 106, 107 in closed position are preferably dimensioned such, that they form a double sealing. The engaging strip 104 is constructed in a highly compressible material of which the compressibility is chosen such, that the strip can deform elastically to enable opening of the door in this direction, in other words that the complementary edge part can effectively pass by the engaging strip.

The lightly compressible material for the blocking strip is preferably EPDM rubber, but other natural or synthetic rubbers or lightly compressible plastic materials are also possible.

The highly compressible material for the engaging strip is preferably polyurethane foam in a polyethylene coating, but other highly compressible materials are also possible. Especially suitable for this purpose are the Q-LON-strips which are put on the market by manufacturer Schlegel (solely) as sealing strips. Surprisingly, these Q-LON strips appear to be also very suitable as elastically deformable engaging strip to maintain a rotatable door in closed position. In FIG. 26 the Q-LON-strip with reference QL9112 is shown. In the tooth-shaped part a hard element 134 is provided which provides the snap connection.

The door assemblies shown are rotatable doors which can be opened in only one direction. In order to convert these door assemblies to rotatable doors which can be opened in both directions, one can simply exchange the blocking strip 105 for an engaging strip 104. Further, it is possible within the framework of the invention to provide an array of engaging strips which are compressible to different extents and/or of different sizes, to be able to accurately adapt the closing system to the circumstances, such as for example the distance between the complementary edge part and the holder part.

As shown in FIG. 20, the holder profile 103 is symmetrical with respect to the middle part 130. As a result of this and the fact that the holder profile 103 is snap-fitted to the intermediate profile 102 (or another profile of the door assembly), the user can also change the direction in which the door can be opened by removing the holder profile 103 with the strips 104 and 105 as a whole and repositioning it in opposite direction.

As shown in FIGS. 18 and 19 the opposite profile 106 has the same width and the same side recesses as the holder profile 103. As a result, these two profiles are mutually exchangeable if desired.

The other profiles of the door assembly shown in the FIGS. 16-26 correspond to profiles described with reference to FIGS. 1-15 and therefore need no further explanation here.

The invention claimed is:

1. A door assembly, said door assembly for mounting in a wall opening, said door assembly comprising two opposite members, at least one of which being a rotatable door, and a closing system which is provided for being mounted to a first one of the opposite members, wherein the closing system comprises a holder profile, the holder profile comprising a middle part with holding parts on opposite sides of the middle part, at least one engaging member engaging a respective edge part on a second one of said opposite members to maintain the door in a closed position, the engaging member being at least partly elastically deformable enabling opening of the door in a first direction when a user pushes the door, said at least one engaging member having first and second parts, said engaging member first part being positioned in a respective first one of said holding parts of said holder profile and said engaging member second part releasably engaging a first portion of said respective edge part; and a blocking member which prevents opening of the door in one direction, said blocking member having first and second parts, said blocking member first part being positioned in a respective second one of said holding parts of said holder profile and said blocking member second part engaging a second portion of said respective edge part on the second one of said opposite members;

wherein the engaging and blocking members are formed by exchangeable strips which are to different extents compressible and which are releasably mountable to either of the first and second holding parts of the holder profile of the closing system, and further including an intermediate profile, said intermediate profile separate and distinct of said holding profile and having first and second sides, said first side having a projection to be fit into a recess in one of said opposite members, and said second side having at least one engaging projection, and said holder profile having at least one recess to receive the engaging projection of said intermediate profile.

2. A door assembly according to claim 1, wherein the exchangeable strips each comprise a protruding part, which protrudes with respect to the holder profile.

3. A door assembly according to claim 2, wherein at least one of the strips comprises a protruding part in a compressible material, so that said at least one of the strips forms an engaging strip for maintaining the door in closed position and enabling opening of the door by compression of the protruding part.

4. A door assembly according to claim 3, wherein the compressible material is polyurethane foam in a polyethylene coating.

5. A door assembly according to claim 2, wherein at least one of the strips comprises a protruding part in a compressible material, so that said at least one of the strips forms a blocking strip for preventing opening of the door in one direction.

6. A door assembly according to claim 5, wherein the compressible material is EPDM rubber.

7. A door assembly according to claim 1, wherein the exchangeable strips comprise at least one engaging strip and a blocking strip, the engaging strip protruding less with respect to the holder profile than the blocking strip and the engaging strip being more compressible than the blocking strip.

* * * * *